US007686291B2

(12) United States Patent
Miyazawa

(10) Patent No.: US 7,686,291 B2
(45) Date of Patent: Mar. 30, 2010

(54) SHEET CONVEYANCE DEVICE

(75) Inventor: Takuji Miyazawa, Kanagawa (JP)

(73) Assignee: Fuji Xerox Co., Ltd., Tokyo ( * ) Notice: Subject to any disclaimer, the term of this patent is extended or adjusted under 35 U.S.C. 154(b) by 215 days.

(21) Appl. No.: 11/209,819

(22) Filed: Aug. 24, 2005

(65) Prior Publication Data

US 2006/0049572 A1 Mar. 9, 2006

(30) Foreign Application Priority Data

Sep. 6, 2004 (JP) ..... P2004-258339

(51) Int. Cl.
*B65H 3/06* (2006.01)

(52) U.S. Cl. ..... 271/117; 271/121

(58) Field of Classification Search ..... 271/4.03, 271/10.03, 10.11, 110, 117, 118, 121, 122
See application file for complete search history.

(56) References Cited

U.S. PATENT DOCUMENTS

| | | | | |
|---|---|---|---|---|
| 6,131,898 | A * | 10/2000 | Hiroi et al. | 271/10.03 |
| 6,493,113 | B1 * | 12/2002 | Fujii et al. | 358/488 |
| 6,615,105 | B2 * | 9/2003 | Masotta | 700/219 |
| 7,156,389 | B2 * | 1/2007 | Kadowaki et al. | 271/118 |
| 7,571,905 | B2 * | 8/2009 | Kim | 271/117 |
| 2002/0033572 | A1 * | 3/2002 | Takisawa et al. | 271/109 |
| 2005/0023745 | A1 * | 2/2005 | Morimoto et al. | 271/117 |
| 2005/0073087 | A1 * | 4/2005 | Kadowaki et al. | 271/118 |
| 2005/0225022 | A1 * | 10/2005 | Akiyama et al. | 271/10.03 |
| 2005/0263954 | A1 * | 12/2005 | Worley et al. | 271/114 |
| 2006/0098072 | A1 * | 5/2006 | Takeuchi et al. | 347/104 |

FOREIGN PATENT DOCUMENTS

| | | | |
|---|---|---|---|
| JP | HEI-01-092137 | | 4/1989 |
| JP | 01299133 | A * | 12/1989 |
| JP | 05132173 | A * | 5/1993 |
| JP | 2001146329 | A * | 5/2001 |

* cited by examiner

*Primary Examiner*—Patrick H Mackey
*Assistant Examiner*—Michael C McCullough
(74) *Attorney, Agent, or Firm*—Morgan, Lewis & Bockius LLP

(57) ABSTRACT

A sheet conveyance device includes a pick-up roller, a handling member, and a roller-movement-timing changing unit. The pick-up roller is movable between a feeding position where a recording sheet stacked in a sheet tray is fed and a feed standby position where the pick-up roller is separated from the recording sheet. The handling member is disposed on downstream of the pick-up roller in a sheet conveyance direction. The handling member separates the recording sheet fed by the pick-up roller one by one and conveys the separated recording sheet. The roller-movement-timing changing unit changes roller movement timing at which the pick-up roller is moved from the feeding position to the feed standby position, in accordance with a sheet information of a used recording sheet.

12 Claims, 19 Drawing Sheets

SHEET FEEDING PROCESS (MAIN FLOW)

NORMAL SHEET FEEDING PROCESS
(SUB ROUTINE OF ST5)

PICK-UP ROLLER-MOVEMENT-TIMING CHANGING SHEET FEEDING PROCESS (SUB ROUTINE OF ST6)

PICK-UP ROLLER-MOVEMENT-TIMING CHANGING SHEET FEEDING PROCESS (SUB ROUTINE OF ST6)

NOISE-PREVENTING-MODE SELECTING PROCESS

SHEET FEEDING PROCESS (MAIN FLOW)

SHEET CONVEYANCE DEVICE

BACKGROUND OF THE INVENTION

1. Field of the Invention

The present invention relates to a sheet conveyance device that feeds a recording sheet stacked in a sheet tray and more particularly to a sheet conveyance device in which a feed roll for feeding a recording sheet is movable between a feeding position and a feed standby position.

2. Description of the Related Art

An image forming apparatus such as a facsimile, a printer, and a copier has a sheet conveyance device such as a document feeder or a manual feeder for conveying a recording sheet. It has been known that the sheet conveyance device includes a pick-up roller for feeding the recording sheets, a feed roll, which is disposed on downstream of the pick-up roller in the sheet conveyance direction and conveys the recording sheet fed by the pick-up roller downstream, and a retard roll for separating the recording sheets one by one by pressing the recording sheets along with the feed roll.

When the recording sheets are separated one by one between the feed roll and the retard roll, the separated recording sheet may be dragged by a recording sheet to be carried downstream and may be conveyed again between the feed roll and the retard roll (a handling region). When the separated recording sheet is conveyed repeatedly to the handling region, noises (handling abnormal noises) may be caused. Particularly, in case of recording sheets having a low frictional coefficient between the recording sheets such as OHP sheets not closely contacting with each other or in case of recording sheets having a small size and a small weight such as postcards, the recording sheets can be easily moved. Accordingly, the handling abnormal noises may be easily caused.

As a technique for preventing the movement of the separated recording sheets, there has been known the following technique.

A pressing roller is disposed on upstream of a pick-up roller (call-out roller) in a sheet conveyance direction. Even after the pick-up roller is separated from a recording sheet, the movement of the separated recording sheets is prevented by pressing the upper surface of the recording sheet with the pressing roller. By using this technique, it is possible to prevent a recording sheet separated and dragged by the uppermost recording sheet from being conveyed again to the handling region.

SUMMARY OF THE INVENTION (Problems of Prior Art)

In the above-mentioned technique, since the pressing roller should be newly provided in addition to the pick-up roller, the feed roll, and the retard roll, there arise problems that cost increases, structure becomes complicated, and size increases.

Instead of the technique of providing the pressing roller, it can be considered that a structure of always bringing the pick-up roller into contact with a bundle of recording sheets without separating the pick-up roller from the bundle of recording sheets is employed so as to prevent the separated recording sheets from being repeatedly conveyed to the handling region by means of pressure with which the pick-up roller presses the recording sheets. However, in the manual feeder or the document feeder, if the pick-up roller is always held at the feeding position where the pick-up roller contacts with the recording sheets, when a user adds or replenishes recording sheets, the pick-up roller interferes with the user's replenishment operation, which is a problem. In addition, when the pick-up roller is always brought into contact with the bundle of recording sheets during feeding the recording sheets, there arises a problem that the pick-up roller contacting with the recording sheets acts as a conveyance resistance against the recording sheets to be conveyed by the feed roll.

In view of the circumstances, the present invention has the following objects (001) and (002):

(001) To prevent a separated recording sheet from being conveyed again to the handling region, with a simple structure; and (002) To prevent a separated recording sheet from being conveyed again to the handling region, while not interfering with an operation of adding recording sheets and suppressing a conveyance resistance.

According to one embodiment of the invention, a sheet conveyance device includes a pick-up roller, a handling member, and a roller-movement-timing changing unit. The pick-up roller is movable between a feeding position where a recording sheet stacked in a sheet tray is fed and a feed standby position where the pick-up roller is separated from the recording sheet. The handling member is disposed on downstream of the pick-up roller in a sheet conveyance direction. The handling member separates the recording sheet fed by the pick-up roller one by one and conveys the separated recording sheet. The roller-movement-timing changing unit changes roller movement timing at which the pick-up roller is moved from the feeding position to the feed standby position, in accordance with sheet information of a used recording sheet.

BRIEF DESCRIPTION OF THE DRAWINGS

Embodiment of the invention will be described in detail based on the following figures, wherein.

DETAILED DESCRIPTION OF THE EMBODIMENTS

Figure 1:
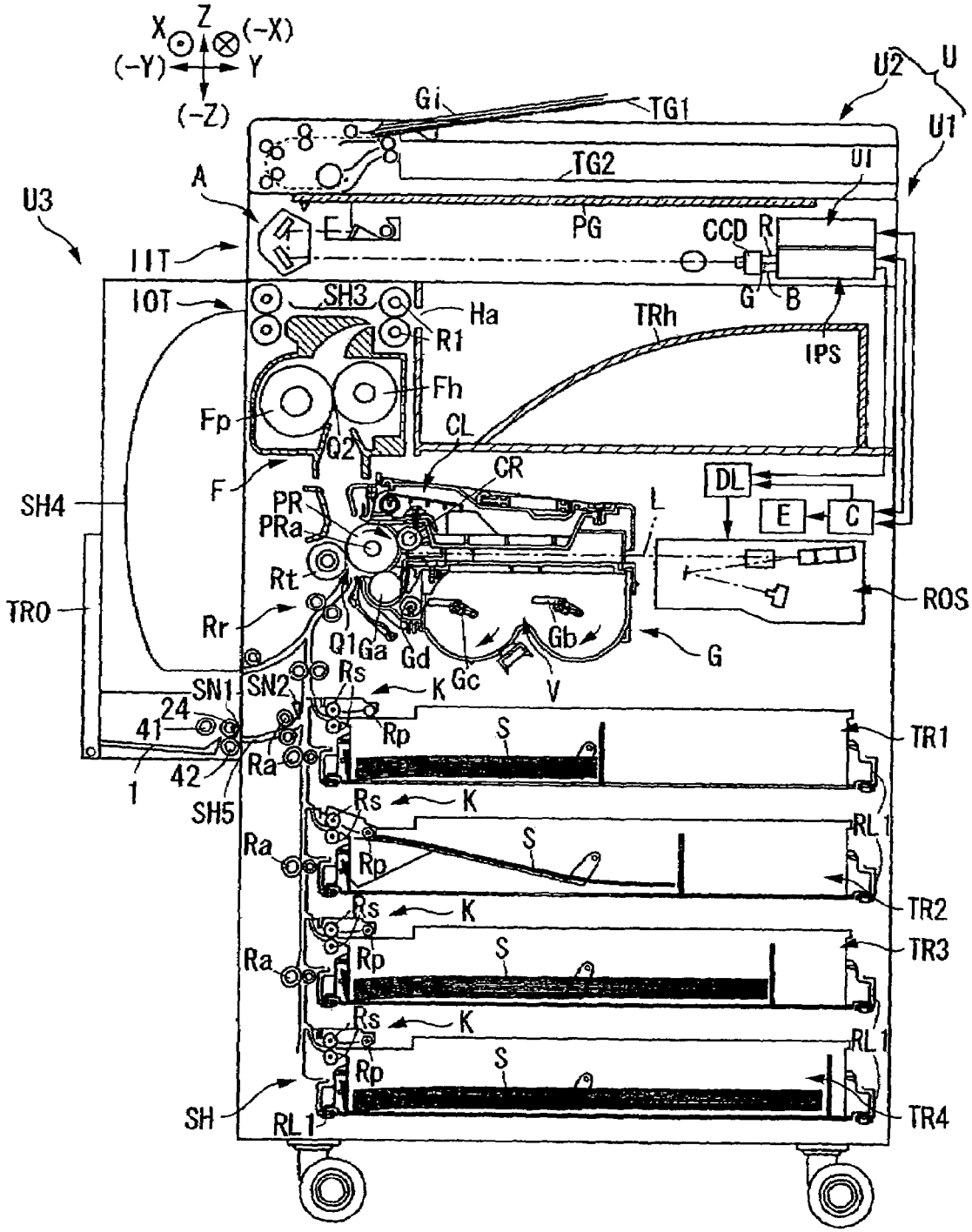
FIG. 1 is a diagram illustrating an entire construction of an image forming apparatus according to an embodiment of the invention.

Hereinafter, exemplary embodiments of the invention will be described with reference to the accompanying drawings, but the invention is not limited to the exemplary embodiments.

In order to easily understand the embodiments of the invention, in the drawings, the front-and-back direction is denoted by an X axis direction, the left-and-right direction is denoted by a Y axis direction, and the up-and-down direction is denoted by a Z axis direction. In addition, the directions indicated by arrows X, -X, Y, -Y, Z, and -Z are denoted by forward, backward, right, left, upward, and downward, respectively. In addition, in the drawings, a symbol that "•" is marked in "O" denotes an arrow from the rear surface of the paper of the drawing to the front surface thereof, and a symbol that "x" is marked in "O" denotes an arrow from the front surface of the paper of the drawings to the rear surface thereof.

First Embodiment

FIG. 1 is a diagram illustrating an entire configuration of an image forming apparatus according to an embodiment of the invention.

In FIG. 1, the image forming apparatus (a digital copier) U according to the embodiment includes an image forming apparatus body U1 and an automatic document feeder U2. The image forming apparatus body U1 includes IOT (Image Output Terminal) and IIT (Image Input Terminal, that is, an image reading section).

The automatic document feeder U2 is supported on a platen glass (PG) on the top surface of the IIT.

On the IOT, a sheet discharge tray TRh is disposed on the IOT between the IOT and the IIT.

In FIG. 1, the automatic document feeder U2 has a document feeding tray TG1 on which a plurality of documents Gi to be copied are stacked. The documents Gi stacked on the document feeding tray TG1 are discharged to a document discharging tray TG2 sequentially through a copying position on the platen glass PG. The automatic document feeder U2 can be rotated about a hinge shaft (not shown), which is provided at the rear end (−X end) and extends in the lateral direction, with respect to the top surface of the platen glass PG and is rotated upwardly when an operator puts a document Gi on the platen glass PG with his hand.

The image forming apparatus body U1 has a user interface (UI) through which a user inputs an operation instruction such as copy start, etc.

An exposure optical system A for reading copy images is disposed under the transparent platen glass PG.

Reflected light from a document having fed onto the platen glass PG by the automatic document feeder U2 or a document (not shown) manually put onto the platen glass PG is converted into electrical signals by a CCD (solid-state image capturing device) through the exposure optical system A.

An image processing system (IPS) converts the RGB electrical signals input from the CCD into image data and temporarily stores the image data and outputs the image data as image data for forming a latent image to a laser driving circuit DL at predetermined timing.

The laser driving circuit DL outputs a laser driving signal to a latent forming device ROS in accordance with the input image data. In addition, a controller C controls an operation of the user interface UI, an operation of the image processing system IPS, an operation of the laser driving circuit DL, and an operation of a power source circuit E for applying a bias voltage to a development roller Ga and a transfer roller Rt described later.

An image carrier (PR) including a photosensitive drum is rotated along with its shaft RPa in the arrow direction (clockwise direction in FIG. 1) and its surface is charged uniformly by a charging roller (CR). Thereafter, latent image formation positions are exposed and scanned by a laser beam L of the latent image forming device ROS, whereby an electrostatic latent image is formed thereon.

The surface of the image carrier (PR) on which the electrostatic latent image is formed sequentially passes through a developing region (a region facing the development roller Ga) and a transfer region (a region facing the transfer roller Rt) Q1 with its rotation.

A developing device G has a development vessel V for rotatably supporting the development roller Ga and developer stirring members Gb, Gc, and Gd rotatably and accommodating a developer. The developing device G develops the electrostatic latent image on the image carrier PR passing through the developing region as a toner image.

A plurality of sheet trays TR1 to TR4 (see FIG. 1) accommodates recording sheets to be conveyed to the transfer region Q1 and is supported to be movable along a pair of rails RL1 and RL1 disposed at both lateral sides (both sides in the Y axis direction) in the front-and-back direction (the direction perpendicular to the paper of FIG. 1).

In FIG. 1, each sheet feeding device K disposed at the upper feeding side of the sheet trays TR1 to TR4 has a pick-up roller 41, a handling roller Rs including a feed roller and a retard roller, and a member (not shown) for rotating the rollers. The recording sheets S picked up by the pick-up roller 41 of the sheet feeding device K are separated one by one in the pressing region (handling region) between the feed roller Rs1 and the retard roller Rs2 and are conveyed to a sheet conveying path SH. The recording sheet S on the sheet conveying path SH is conveyed to a register roller by sheet conveying rollers (takeaway roller) Ra disposed along the sheet conveying path SH. The register roller Rr (see FIG. 1) conveys the recording sheet S to the transfer region Q1 at predetermined timing.

The recording sheet S supplied from the manual tray TR0 is conveyed along a manually-fed-sheet conveying path SH5 and is conveyed to the transfer region Q1 by the sheet conveying rollers (takeaway rollers) Ra and the register roller Rr disposed along the sheet conveying path SH.

In FIG. 1, a transfer roller Rt to which a transfer bias is applied is disposed in the transfer region Q1. The transfer roller Rt is pressed on the image carrier PR in the transfer region Q1 and transfers the toner image on the image carrier PR to the recording sheet S passing through the transfer region Q1.

After the toner image on the image carrier PR is transferred to the recording sheet S in the transfer region Q1, a remaining toner attached to the surface of the image carrier PR is collected by a cleaner CL. The image carrier PR from which the remaining toner is collected by the cleaner CL is charged by the charging roller CR.

The recording sheet S to which the non-fixed toner image is transferred in the transfer region Q1 is conveyed to a fixing region Q2 in a state where the toner image is not fixed. The toner image is fixed by a pair of fixing rollers Fh and Fp of a fixing device F disposed in the fixing region Q2. The recording sheet S on which the fixed toner image is formed is conveyed to a discharge roller R1 by means of a sheet guide and is discharged from a sheet discharging port Ha to a sheet discharging tray TRh.

A body sheet inverting path SH3 connected to the sheet discharging port Ha is provided in the printer U. A sheet inverting device U3 is provided above the manual tray TR0. An option sheet inverting path SH4 connected to the body sheet inverting path SH3 is formed in the sheet inverting device U3. Therefore, at the time of printing both sides, the recording sheet S to which the toner image is fixed in the fixing region Q2 passes through the body sheet inverting path SH3 and the option sheet inverting path SH4, is conveyed by the register roller Rr, and is conveyed again to the transfer region Q1 in a state where the recording sheet S is inverted.

The body sheet inverting path SH3 and the option sheet inverting path SH4 constitute a sheet inverting path (SH3+SH4).

(Manual Tray)

Figure 2:
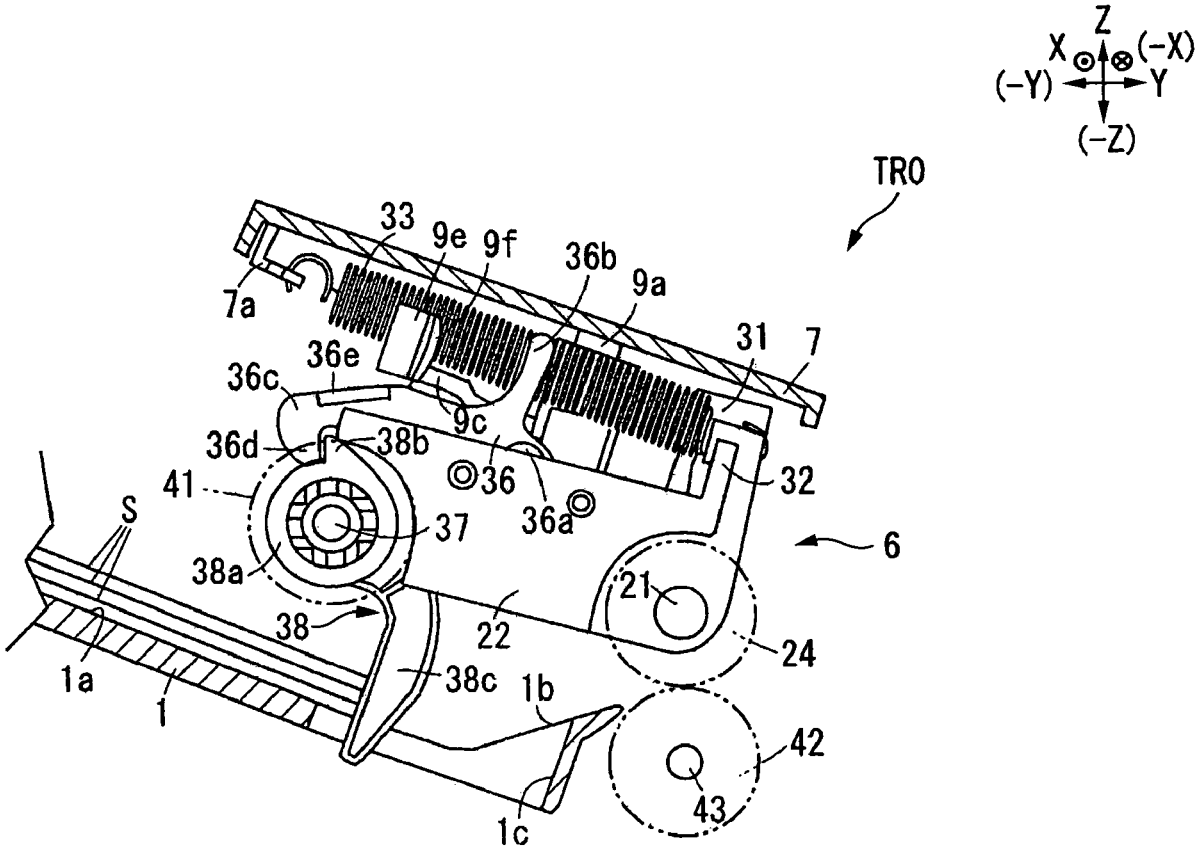
FIG. 2 is an enlarged perspective view illustrating a sheet feeding device of a manual tray according to a first embodiment of the invention, wherein a pick-up roller is held at a feed standby position.

FIG. 2 is an enlarged perspective view illustrating the sheet feeding device of the manual tray according to the first embodiment of the invention, wherein the pick-up roller is held at a feed standby position.

Figure 3:
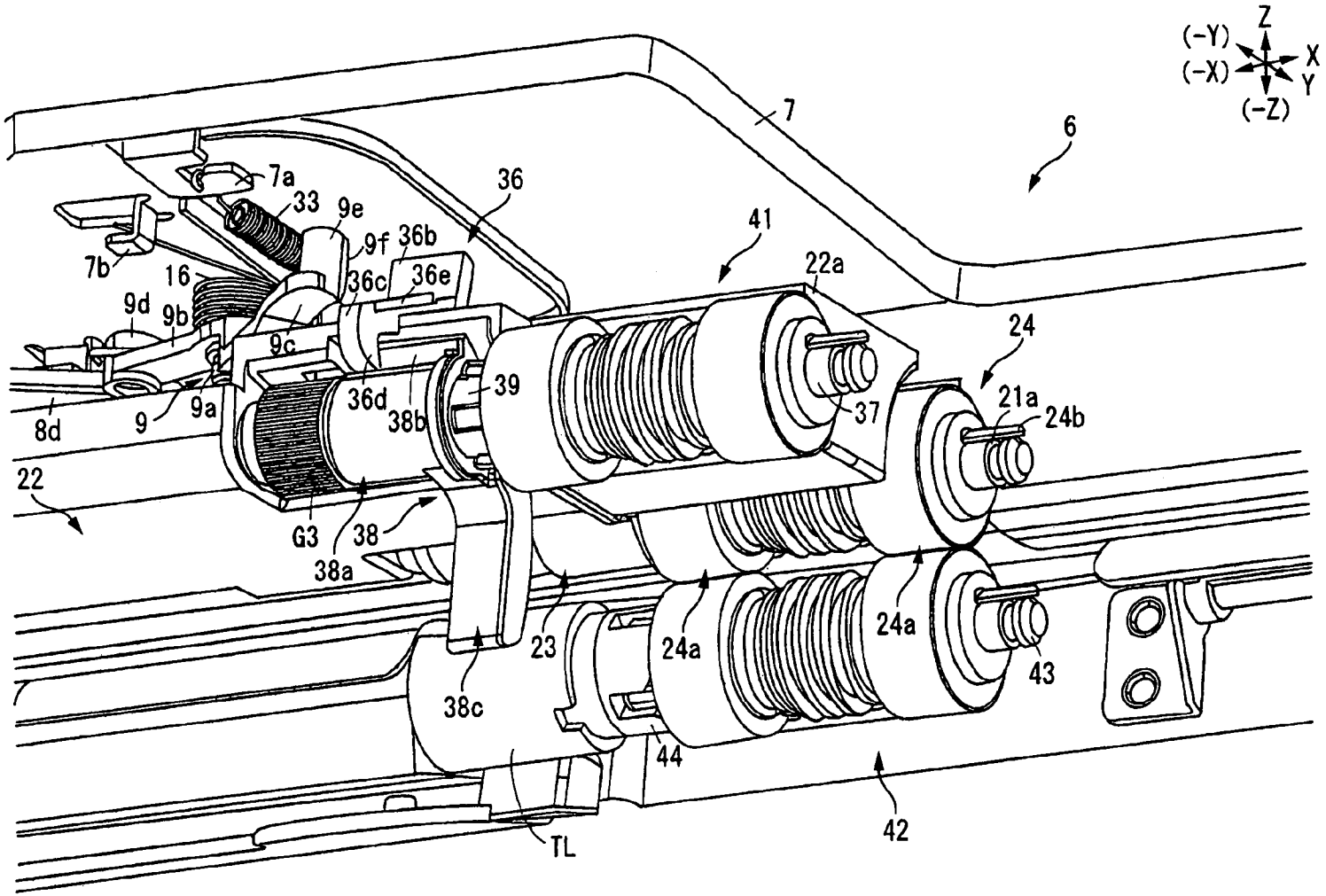
FIG. 3 is an enlarged perspective view illustrating the sheet feeding device of the manual tray according to the first embodiment as seen from a bottom side.

FIG. 3 is an enlarged perspective view illustrating the sheet feeding device of the manual tray according to the first embodiment as seen from a bottom side.

Figure 4:
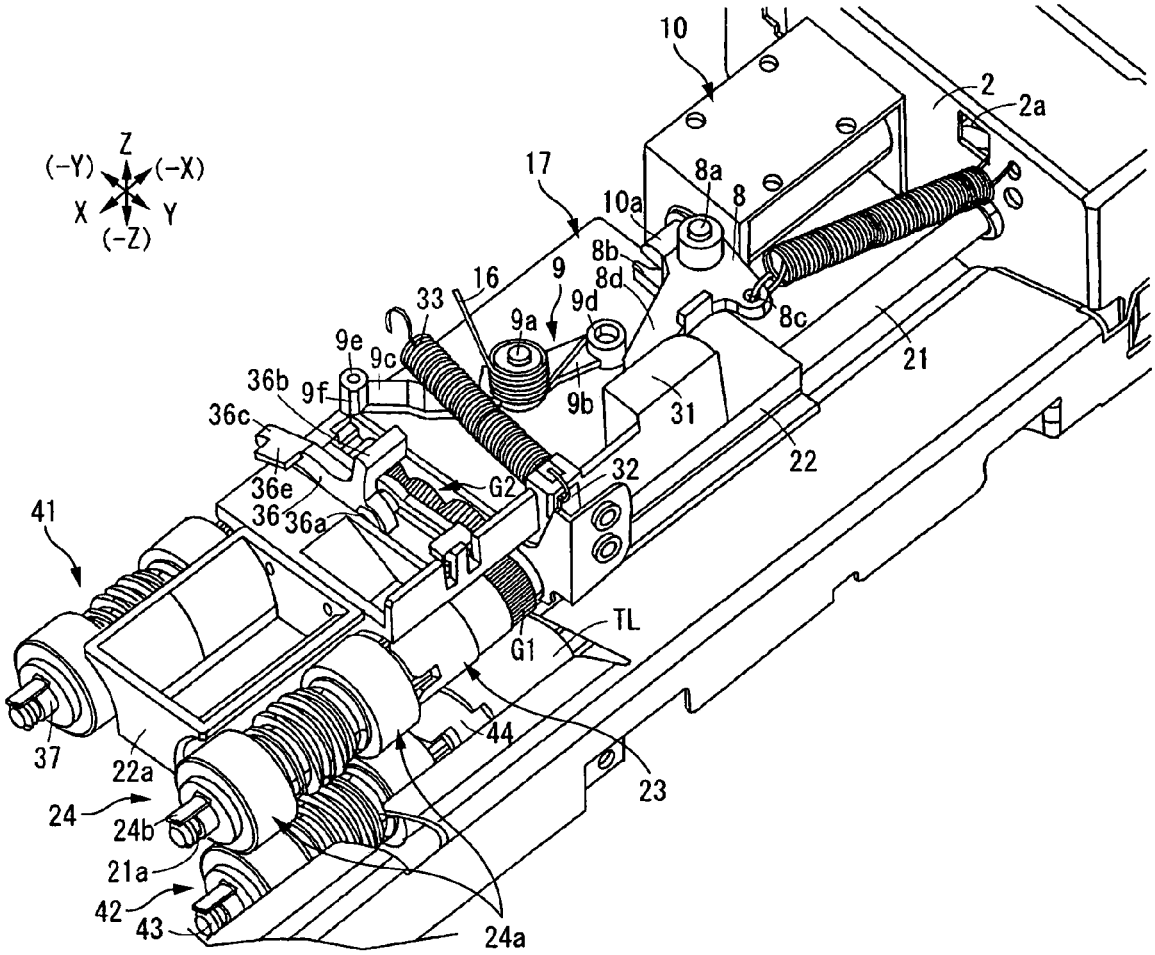
FIG. 4 is an enlarged perspective view illustrating the sheet feeding device of the manual tray according to the first embodiment as seen obliquely from a top side.

FIG. 4 is an enlarged perspective view illustrating the sheet feeding device of the manual tray according to the first embodiment as seen obliquely from a top side.

Figure 5:
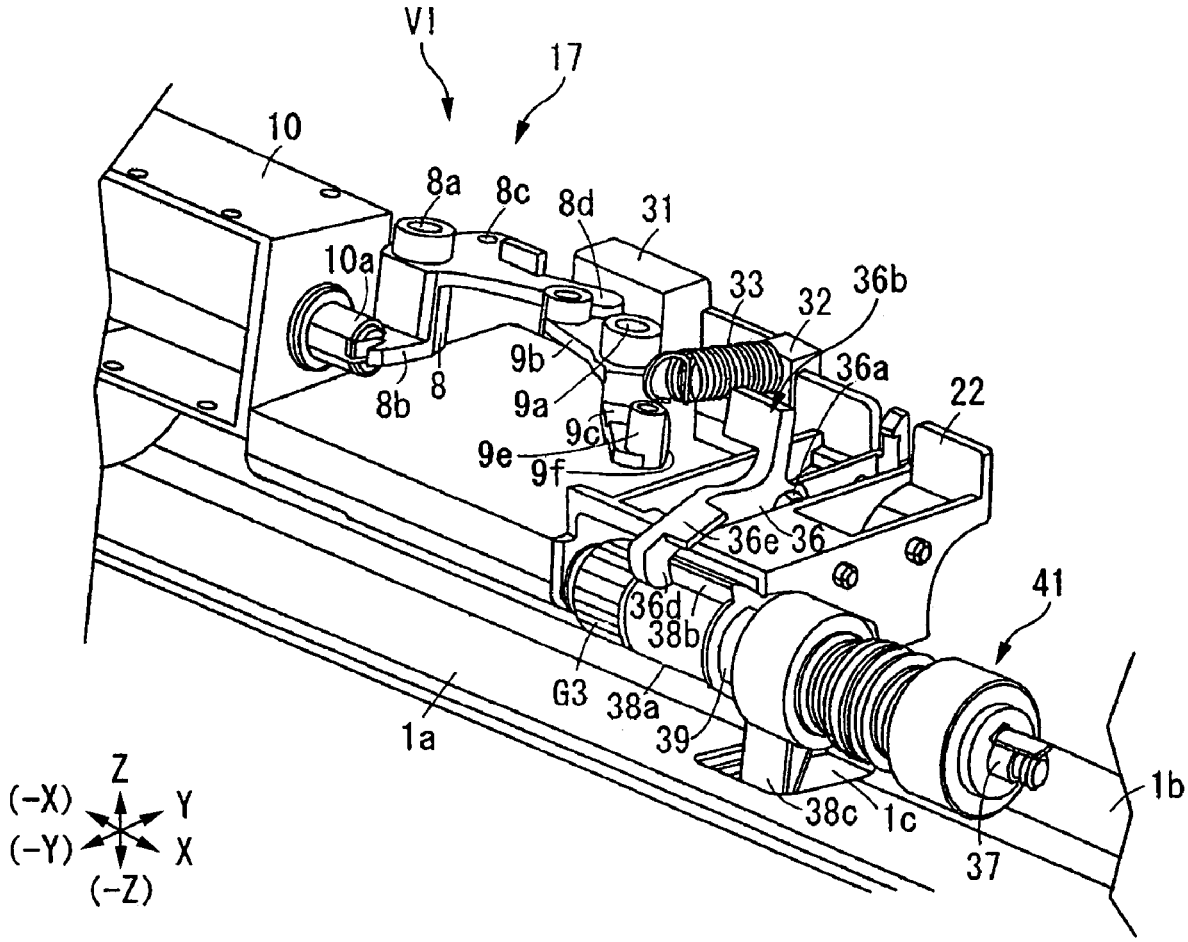
FIG. 5 is a perspective view illustrating the sheet feeding device from which a handling roller and a guide member are omitted.

FIG. 5 is a perspective view illustrating the sheet feeding device from which the handling roller and the guide member are omitted.

Figure 6:
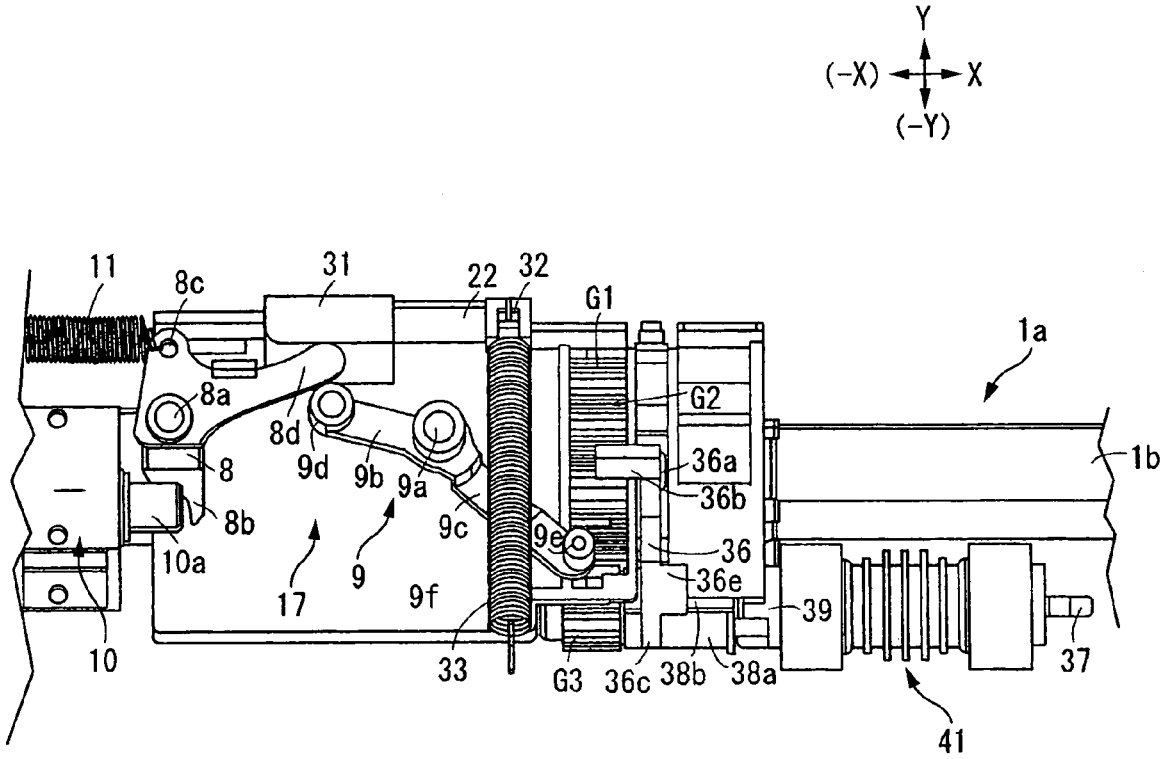
FIG. 6 is a diagram seen in the arrow direction VI of FIG. 5.

FIG. 6 is a diagram seen in the arrow direction VI of FIG. 5.

In FIGS. 2 and 3, the manual tray TR0 having a sheet conveyance device according to the first embodiment of the invention has a sheet tray body 1 in which recording sheets S are (received) stacked in a state where the front ends of the recording sheets S in the sheet conveyance direction are inclined downward. In FIG. 2, the sheet tray body 1 has a sheet supporting plane 1*a* on which a bundle of recording sheets S are stacked and a sheet upward-guiding plane 1*b* that is connected to the right end (the front end in the sheet conveyance direction) of the sheet supporting plane 1*a* and is formed upwardly oblique. In FIGS. 2 and 5, an opening 1*c* for receiving a member 38 (described later) is formed from the sheet supporting plane 1*a* of the right end of the sheet tray body 1 to the sheet upward-guiding plane 1*b*.

In FIG. 4, a rear wall 2 is formed at the rear end of the sheet tray body 1. A spring fitting hole 2*a* is formed in the rear wall 2.

In FIGS. 2 and 3, a manual sheet feeding device 6 is disposed above the right end of the sheet tray body 1. The manual sheet feeding device 6 has a flat fixing plate 7. In FIGS. 2 and 3, the fixing plate 7 has a portion 7*a* for supporting a urging spring 33 and a portion 7*b* for supporting a twist spring 16 (see FIG. 3). The portions 7*a* and 7*b* protrude downwardly. A link 8 for lifting the pick-up roller and an unlocking link 9 are rotatably supported on the bottom surface of the fixing plate 7.

In FIGS. 4 to 6, the link 8 has a cylinder-shaped rotation center 8*a*, a portion 8*b*, which is connected to a solenoid 10 and formed at the left of the rotation center 8*a*, a portion 8*c* to which a spring 11 for hold a standby position is fitted, and a portion 8*d*, which presses a casing and is formed in the front of the portion 8*c*. The portion 8*c* is formed at the right of the rotation center 8*a*. The portion 8*b* is rotatably connected to the front end of an extensible rod 10*a* of a solenoid 10 for lifting the pick-up roller 41. The spring 11 is connected between the portion 8*c* and the spring fitting hole 2*a* of the rear wall 2. Therefore, the link 8 is biased by the spring 11 in a direction (counterclockwise direction in FIG. 6) in which the portion 8*d* is moved to right about the rotation center 8*a*.

The unlocking link 9 has a cylinder-shaped rotation center 9*a*, a link-side arm 9*b* extending from the rotation center 9*a* toward the link 8, and an unlocking arm 9*c* extending oppositely to the link-side arm 9*b*. A cylinder-shaped portion 9*d* engaging with the lifting link 8 is formed at the front end of the link-side arm 9*b*. A cylinder-shaped portion 9*e* engaging with a stopper 36 is formed at the front end of the unlocking arm 9*c* and a convex curved portion 9*f* of which the vertical central portion is curved convex for engaging with the stopper 36 (described later) is formed on the rear end surface of the portion 9*e*.

In FIGS. 3 and 4, the central portion of the twist spring 16 is wounded around the rotation center 9*a* (not shown other than in FIGS. 3 and 4). An end of the twist spring 16 is fitted to the portion 7*b* and the other end is coupled to the portion 9*d*. Therefore, the unlocking link 9 is biased by the twist spring 16 in the direction (clockwise direction in FIG. 6) in which the portion 9*d* is moved to right about the rotation center 9*a*. As a result, the portion 9*d* always comes in contact with the left end surface of the portion 8*d* of the link 8.

The link 8, the unlocking link 9, the spring 11, and the twist spring 16 constitute a link mechanism 17. The solenoid 10 and the link mechanism 17 constitute a member 10+17 for releasing engagement with the stopper.

In FIG. 4, a shaft 21 extending forwardly is rotatably supported by the rear wall 2 and is rotated by a feed motor not shown. A casing 22 for supporting the pick-up roller 41 is rotatably supported by the shaft 21. In the front of the casing 22, a gear G1 for driving the pick-up roller 41 is supported by the shaft 21 through a one-way clutch (not shown). The gear G1 and the shaft 21 are connected to each other to be able to idle in a direction in which the pick-up roller 41 (described later) conveys the sheets, by means of the one-way clutch. In the front of the gear G1, a member 23 to which the feed roller 24 is fitted is supported through a one-way clutch (not shown)

and is connected to the one-way clutch such that the feed roller 24 is able to idle about the shaft 21 in the sheet conveyance direction.

The member 23 is fitted with the feed roller 24 having two roller portions 24*a* and 24*a* and a sheet guide portion disposed between the roller portions 24*a* and 24*a*. A positioning protrusion portion 24*b* is formed at the front end of the feed roller 24. Accordingly, by engaging the positioning protrusion portion 24*b* with a roll positioning groove 21*a* formed at the front end of the shaft 21, the axis direction of the feed roller 24 is positioned.

In FIGS. 3 and 4, a guide member 22*a* for guiding the top surface of the carried recording sheet S is supported by the front end surface of the casing 22. In FIGS. 4 to 6, a pressed portion 31 coming in contact with the portion 8*d* of the link 8 is formed in the right-rear portion of the top surface of the casing 22. A portion 32 to which a spring 33 for urging a feeding position is fitted is formed in front of the pressed portion 31. In FIGS. 2 and 3, the spring 33 is fitted between the portion 32 and the portion 7*a* of the fixing plate 7 (see FIGS. 3 and 4). The spring 33 urges the portion 32 to the left-upper side (in the −Y+Z direction).

The solenoid 10, the link mechanism 17, and the portion 32 constitute a device (10+17+32) for moving the pick-up roller 41.

In FIG. 4, a rotation transmitting gear train G2 is rotatably supported by the portion 32 of the casing 22, and thus the rotation power is transmitted thereto from the gear G1. The stopper 36 is supported in front of the rotation transmitting gear train G2 to be rotatable about the rotation center 36*a*. The stopper 36 has a engaged portion 36*b*, which extends upwardly and can be engaged with the portion 9*e* of the unlocking link 9, and a portion 36*c* for engaging with the member 38. The portion 36*c* extends to the left side (in the −Y direction). A engaging claw 36*d* is formed at the front end of the portion 36*c*. A rotation regulating portion 36*e* for regulating the downward rotation of the portion 36*c* is formed at the upper end of the portion 36*c*.

A shaft 37 of the pick-up roller 41 extending in the front-and-back direction (the X direction) is rotatably supported by the left end of the casing 22. In FIGS. 3 and 5, a pick-up roller gear G3 to which the rotation power is transmitted from the rotation transmitting gear train G2 is supported by the rear end of the shaft 37. The member 38 for positioning a front end of a sheet is rotatably supported by the shaft 37 in front of the pick-up roller gear G3. A member 39 to which the pick-up roller 41 is attached is supported by the front end of the shaft 37. The pick-up roller 41 having the same structure as the feed roller 24 is attached to the member 39.

In FIGS. 2, 3, and 5, the member 38 has a cylindrical portion 38*a*, a portion 38*b* engaged with the stopper 36, and a portion 38*c* abutting against a front end of a sheet. The portion 38*b* protrudes from the outer circumferential surface of the cylindrical portion 38*a*. The portion 38*c* is formed on the outer circumferential surface opposite to the portion 38*b*. The portion 38*b* is configured to be engageable with the engaging claw 36*d*. At the time of standby when sheets are not fed, as shown in FIG. 2, the front end of the portion 38*c* is positioned downward through the opening 1*c*. When the front end of the bundle of recording sheets S abut against the portion 38*c*, the portion 38*b* is engaged by the engaging claw 36*d* and the member 38 is locked (stopped) so as not to be rotated from a predetermined position (see FIG. 2). As a result, the front end of the recording sheets S is positioned at the predetermined position.

In FIGS. 3 and 4, the retard roller 42 closely contacting with the feed roller 24 with a predetermined pressure is disposed below the feed roller 24. The retard roller 42 has the same structure as the feed roller 24 and the pick-up roller 41 and is attached to a member 44 supported by a shaft 43 of the retard roller 42 through a torque limiter TL. A rotation power in a direction (direction returning the recording sheets upstream) opposite to the rotation direction of the feed roller 24 is transmitted to the shaft 43 through a transmitting gear not shown from the feed motor. In FIG. 1, a feed sensor SN1 for detecting existence of a recording sheet S is disposed in the vicinity of the downstream of the feed roller 24 in the sheet conveyance direction. A feed-out sensor SN2 for detecting existence of a recording sheet S is disposed in the vicinity of the downstream of a sheet conveying roller (takeaway roll) Ra disposed at the downstream of the feed roller 24.

The feed roller 24 and the retard roller 42 constitute a handling roller (24+42) serving as a handling member. The pick-up roller 41, the handling roller (24+42), and the device (10+17+32) for moving the pick-up roller 41 constitute the manual sheet feeding device (sheet conveyance device) 6.

Therefore, as shown in FIG. 2, in the manual sheet feeding device 6 according to the first embodiment, the solenoid 10 is turned off at the time of generally performing no job (image formation action) and is held at the feed standby position (the position shown in FIG. 2). That is, the portion 8*d* presses the pressed portion 31 against the urging force of the spring 33 with the spring 11, and thus holds the pick-up roller 41 supported by the casing 22 at the feed standby position.

Figure 7:
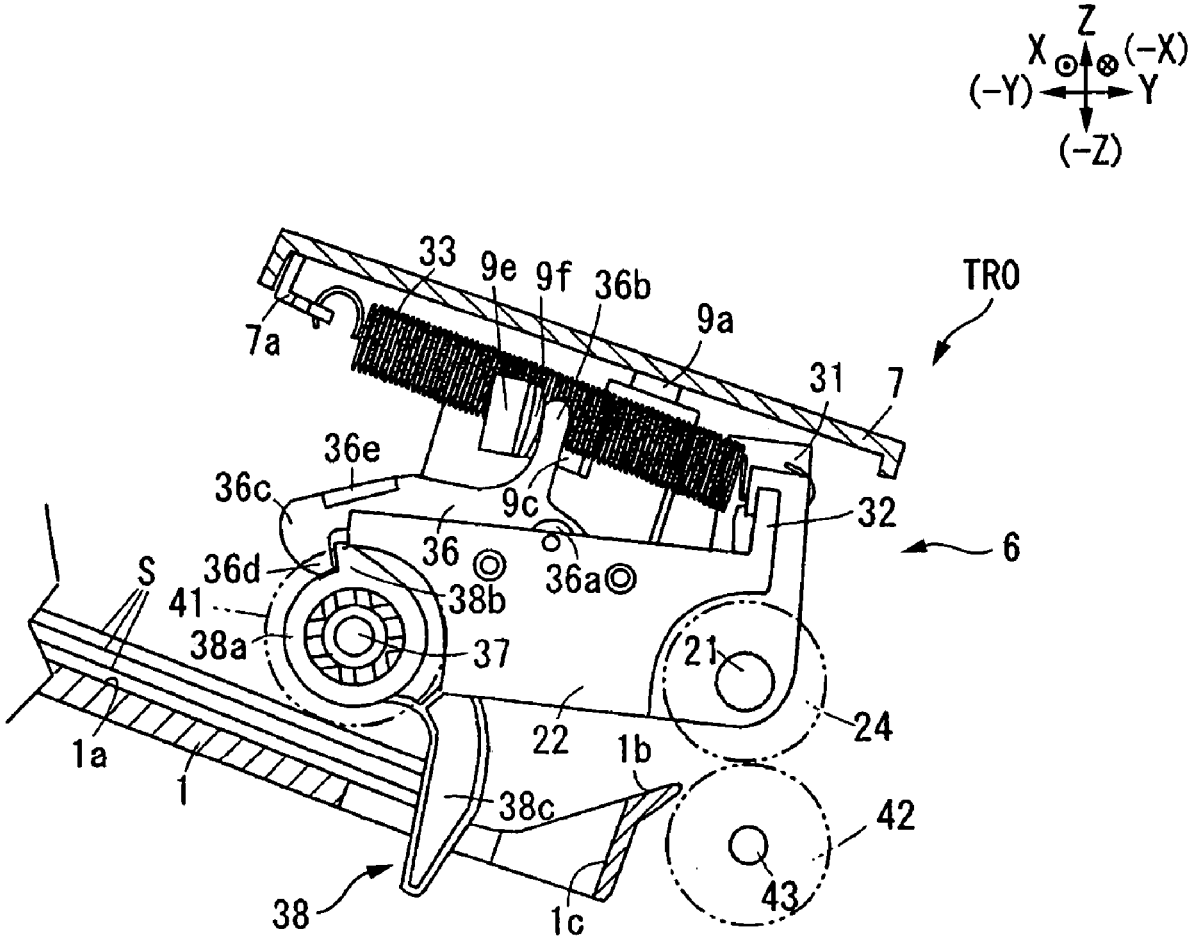
FIG. 7 is an explanatory diagram illustrating a state where the pick-up roller is moved to a feeding position.

FIG. 7 is an explanatory diagram illustrating a state where the pick-up roller 41 has been moved to the feeding position.

In a sate where the bundle of recording sheets S abut against the portion 38*c* so as to be positioned as shown in FIG. 2, a job is started and the solenoid 10 is turned on at the sheet feeding timing. In FIG. 6, when the solenoid 10 is turned on, the extensible rod 10*a* is retracted into the solenoid 10. By means of action of the extensible rod 10*a*, the link 8 is rotated about the rotation center 8*a* against the force of the spring 11. As a result, the portion 8*d* is moved in the direction in which the portion 8*d* gets away from the pressed portion 31 and the casing 22 is rotated about the shaft 21 by means of the urging force of the spring 33. Accordingly, the pick-up roller 41 is moved to the feeding position (the position shown in FIG. 7). The pick-up roller 41 moved to the feeding position presses the bundle of recording sheets S with a predetermined urging force of the spring 33.

Figure 8:
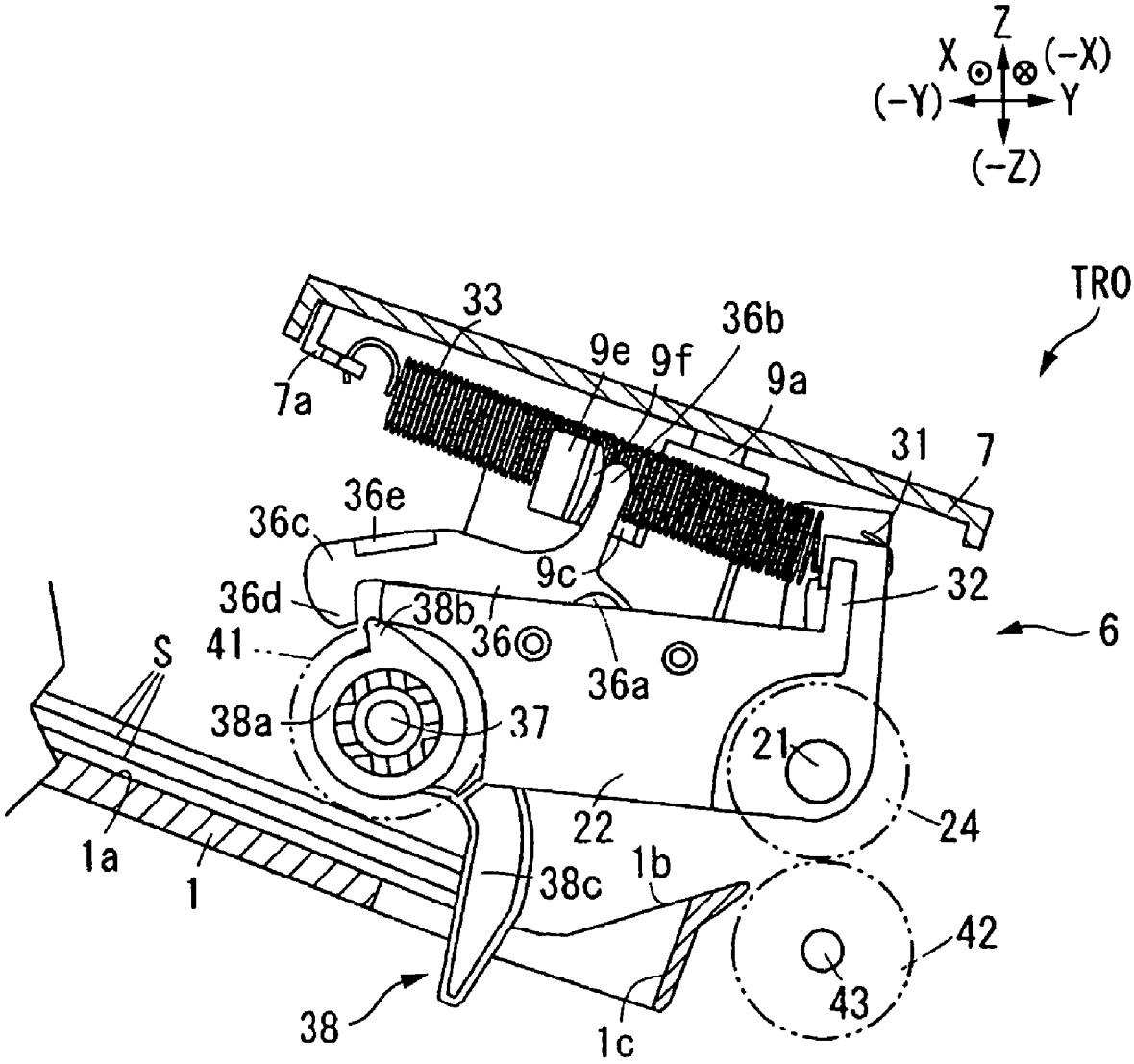
FIG. 8 is an explanatory diagram illustrating a state where the pick-up roller is moved to the feeding position and a sheet-front-end positioning member is unlocked.

FIG. 8 is an explanatory diagram illustrating a state where the pick-up roller 41 has been moved to the feeding position and the member 38 has been unlocked.

In FIG. 6, when the link 8 is rotated by means of action of the extensible rod 10*a* and the portion 8*d* is moved in the direction in which the portion 8*d* gets away from the pressed portion 31, the unlocking link 9 is rotated about the rotation center 9*a* and thus the portion 9*e* comes close to the engaged portion 36*b*. In the state where the pick-up roller 41 has been moved to the feeding position as shown in FIG. 7, the portion 9*e* approaches the engaged portion 36*b*. Thereafter, when the extensible rod 10*a* is completely retracted, the portion 9*e* presses the engaged portion 36*b* to right by means of the rotation of the unlocking link 9 and the stopper 36 is rotated about the rotation center 36*a*. As a result, as shown in FIG. 8, the engagement (locking) between the portion 38*b* and the engaging claw 36*d* is released and the member 38 becomes rotatable.

Figure 9:
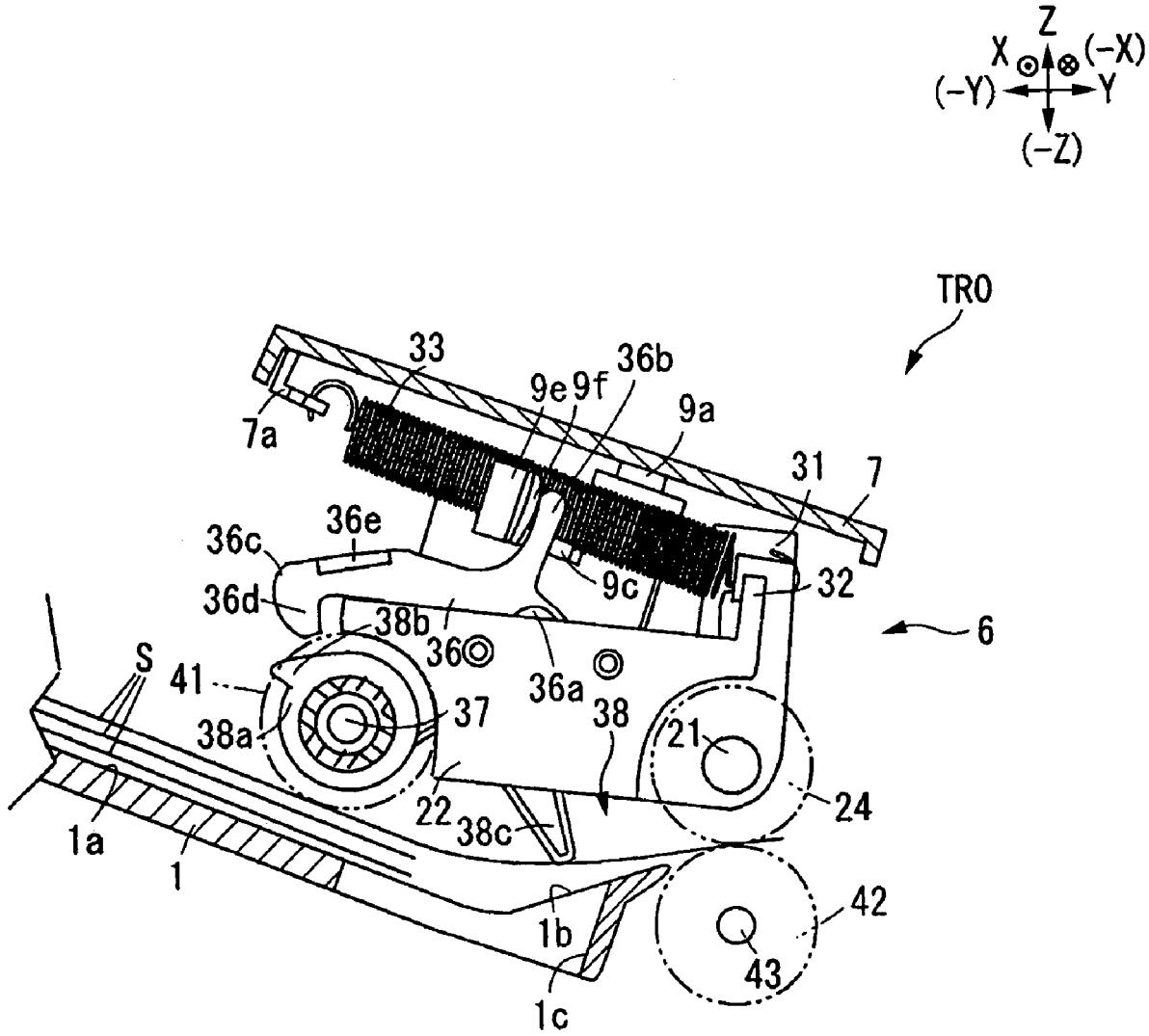
FIG. 9 is an explanatory diagram illustrating a state where the pick-up roller is feeding a recording sheet.

FIG. 9 is an explanatory diagram illustrating a state where the pick-up roller 41 feeds recording sheets.

In FIG. 9, in the state where the member 38 is unlocked, the recording sheet S is conveyed to the handling roller (24+42) by means of rotation of the pick-up roller 41. At this time, since the member 38 is rotatable, the member 38 rotates with the movement of the front end of the recording sheet S and does not interfere with a replenishment operation of the recording sheets S. When a recording sheet S is conveyed to the handling roller (24+42), the retard roller 42 is rotated to follow the rotation of the feed roller 24 by means of the torque limiter and conveys the recording sheet S downstream. On the other hand, when a plurality of recording sheets S are conveyed to the handling roller (24+42), the uppermost recording sheet S abutting against the feed roller 24 is conveyed downstream and the lower-side recording sheets S are returned upstream by the retard roller 42. As a result, the recording sheets S are separated one by one in the pressing region (handling region) between the retard roller 42 and the feed roller 24 and are conveyed downstream.

Description of Controller of First Embodiment

Figure 10:
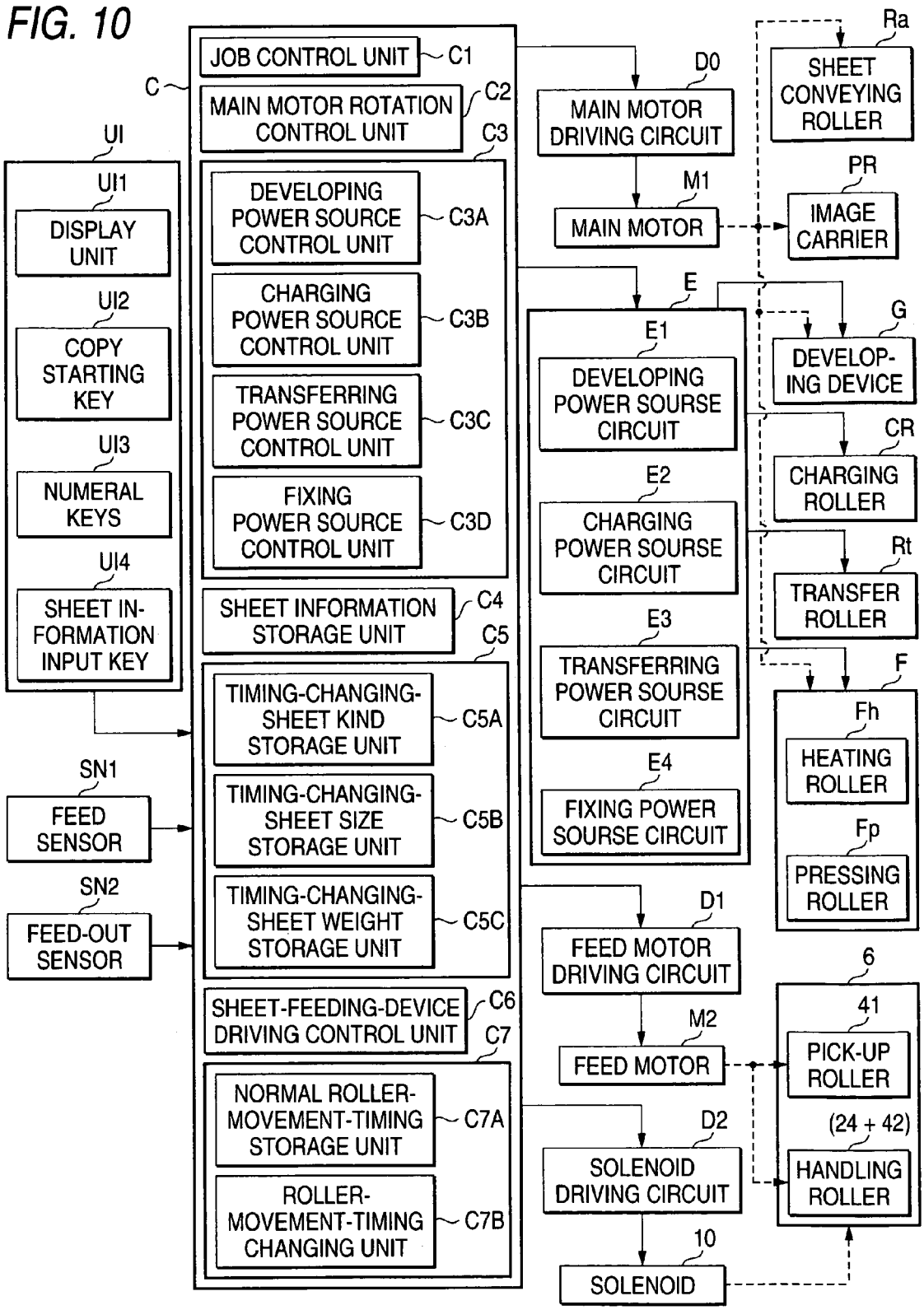
FIG. 10 is a block diagram (functional block diagram) illustrating functions of controllers of an image forming apparatus according to the first embodiment.

FIG. 10 is a block diagram (functional block diagram) illustrating functions of the controller C of the image forming apparatus according to the first embodiment.

In FIG. 10, the controller C includes a micro computer including an input and output interface I/O that performs input and output of signals with external devices and level adjustment of input and output signals, a read only memory (ROM) or a hard disk that stores programs and data for performing necessary processes, a random access memory (RAM) that temporarily stores necessary data, a central processing unit (CPU) that performs processes according to the programs stored in the ROM, etc., and a clock oscillator. The controller C can realize various functions by executing the programs stored in the ROM, etc.

(Signal Input Element connected to Controller C)

Signals are input to the controller C from signal input elements such as the user interface (UI), the feed sensor SN1, the feed-out sensor SN2, and the like.

The UI includes a display unit UI1 and input keys such as a copy starting key UI2, numeral keys UI3, a sheet information input key (sheet information input member) UI4, and the like. The UI detects the input data and inputs the detected signals to the controller C.

The feed sensor SN1 detects the existence of a recording sheet S in the vicinity of the feed roller 24 and inputs the detected signals to the controller C.

The feed-out sensor SN2 detects the existence of a recording sheet S in the vicinity of the sheet conveying roller (take-away roller) Ra and inputs the detected signals to the controller C.

(Control Elements Connected to Controller C)

The controller C is connected to a main motor driving circuit D0, a feed motor driving circuit D1, a solenoid driving circuit D2, a power source circuit E, and other control elements and outputs control signals for driving them.

The power source circuit E has a developing power source circuit E1, a charging power source circuit E2, a transferring power source circuit E3, and a fixing power source circuit E4.

The developing power source circuit E1 applies a developing bias voltage to the developing roller Ga of the developing device G.

The charging power source circuit E2 applies a charging bias voltage to the charging roller CR.

The transferring power source circuit E3 applies a transferring bias voltage to the transfer roller Rt.

The fixing power source circuit E4 supplies heating current to a heater of a heating roller Fh of the fixing device F.

The main motor driving circuit D0 rotates the image carrier PR, the developing roller Ga of the developing device G, the fixing device F, and the sheet conveying roller Ra with using a main motor M1.

The feed motor driving circuit D1 controls the driving of the feed motor M2 and rotates the pick-up roller 41 and the handling roller (24+42).

The solenoid driving circuit D2 activates (turns on or off) the solenoid 10 and moves the pick-up roller 41 between the feeding position and the feed standby position.

(Functions of Controller C)

The controller C has a function (control unit) of performing the processes according to the output signals from the signal output elements and outputting the control signals to the control elements. The function (control unit) of the controller C will be described now.

C1: Job Control Unit

The job control unit C1 controls the actions of the ROS, the image carrier PR, the transfer roller Rt, the fixing device F, and the like in accordance with the input of the copy start key UI2 and executes jobs (print job or copy job), which are image recording actions.

C2: Main Motor Rotation Control Unit

The main motor rotation control unit C2 controls the main motor driving circuit D0 so as to control operations of the image carrier PR, the developing device G, the fixing device F, and the like.

C3: Power Source Circuit Control Unit

The power source circuit control unit C3 has a developing power source control unit C3A, a charging power source control unit C3B, a transferring power source control unit C3C, and a fixing power source control unit C3D and controls the power source circuit E so as to control the power supply to the respective elements of the image forming apparatus U.

C3A: Developing Power Source Control Unit

The developing power source control unit C3A controls the developing power source circuit E1 so as to control the developing bias voltage.

C3B: Charging Power Source Control Unit

The charging power source control unit C3B controls the charging power source circuit E2 so as to control the charging bias voltage.

C3C: Transferring Power Source Control Unit

The transferring power source control unit C3C controls the transferring power source circuit E3 so as to control the transferring bias voltage.

C3D: Fixing Power Source Control Unit

The fixing power source control unit C3D controls the fixing power source circuit E4 so as to control the fixing temperature of the fixing device F.

C4: Sheet Information Storage Unit

The sheet information storage unit C4 stores sheet information of recording sheets S input through the sheet information input key UI4. The sheet information storage unit C4 according to the first embodiment stores kinds (normal sheets, OHP, coated sheets, and one-sided sheets (recording sheets in which images are printed on only one surfaces thereof), or the like) of the recording sheets S, sheet sizes (A4, B5, postcard, or the like), a sheet weight (64 g/m$^2$ or the like).

C5: Timing Changing Determining Unit

The timing changing determining unit C5 includes a timing-changing-sheet kind storage unit C5A and a timing-changing-sheet size storage unit C5B, and a timing-changing-sheet weight storage unit C5C. The timing changing determining unit C5 determines whether or not a recording sheet S is the timing-changing sheet on the basis of the sheet information of the used recording sheet S. The timing changing determining unit C5 according to the first embodiment performs the determination based on whether or not the sheet information stored in the sheet information storage unit C4 is identical with the kinds, the sizes, and the weight of the timing-changing sheet stored in the timing-changing-sheet kind storage unit C5A, the timing-changing-sheet size storage unit C5B, and the timing-changing-sheet weight storage unit C5C.

C5A: Timing-changing-sheet Kind Storage Unit

The timing-changing-sheet kind storage unit C5A stores the kind of the timing-changing sheet for which the roller movement timing should be changed. The timing-changing-sheet kind storage unit C5A according to the first embodiment stores as the kind of the timing-changing sheet, recording sheets having a small frictional coefficient between sheets when they do not closely contact each other, such as OHP sheet, one-sided sheets, coated sheets, and the like.

C5B: Timing-Changing-Sheet Size Storage Unit

The timing-changing-sheet size storage unit C5B stores the size of the timing-changing sheet for which the roller movement timing should be changed. The timing-changing-sheet size storage unit C5B according to the first embodiment stores a postcard size having a small sheet length in the conveyance direction as the size of the timing-changing sheet.

C5C: Timing-changing-sheet Weight Storage Unit

The timing-changing-sheet weight storage unit C5C stores the weight of the timing-changing sheet for which the roller movement timing should be changed. The timing-changing-sheet weight storage unit C5C according to the first embodiment stores a weight smaller than 64 g/m$^2$ (that is, a recording sheet having a relatively small weight) as the weight of the timing-changing sheet.

C6: Sheet-feeding-device Driving Control Unit

The sheet-feeding-device driving control unit C6 controls the rotation of the pick-up roller 41, the feed roller 24, and the retard roller 42 of the manual sheet feeding device 6.

C7: Pick-up Roller Lifting Control Unit (Pick-up Roller Movement Control Unit)

The pick-up roller lifting control unit C7 includes a normal roller-movement-timing storage unit C7A and a roller-movement-timing changing unit C7B. The pick-up roller lifting control unit C7 controls the solenoid driving circuit D3 in accordance with the set roller movement timing, thereby moving (lifting) the pick-up roller 41 between the feeding position and the feed standby position.

C7A: Normal Roller-movement-timing Storage Unit

The normal roller-movement-timing storage unit C7A stores the normal roller movement timing when the used recording sheet S is not the timing-changing sheet, that is, when the roller movement timing for moving the pick-up roller 41 is not changed (roller-movement-timing fixing mode). The normal roller-movement-timing storage unit C7A according to the first embodiment stores as the normal roller movement timing a time point (timing) when the feed sensor SN1 detects the existence of a recording sheet, that is, a time point when the front end of the recording sheet S conveyed from the pick-up roller 41 is detected by the feed sensor SN1.

C7B: Roller-Movement-Timing Changing Unit

The roller-movement-timing changing unit C7B changes the roller movement timing for moving the pick-up roller 41 from the feeding position to the feed standby position in accordance with the sheet information of the used recording sheet. When the used recording sheet S is the timing-changing sheet, the roller-movement-timing changing unit C7B according to the first embodiment changes the roller movement timing from the time point (timing) when the feed sensor SN1 detects the existence of the recording sheet to a time point (timing) when the rear end of the recording sheet S passes through the position of the feed sensor SN1 and no sheet is detected. Therefore, when the recording sheet S is the timing-changing sheet, the roller-movement-timing changing unit C7B according to the first embodiment delays the roller movement timing in comparison with the roller movement timing (normal roller movement timing) when the recording sheet is not the timing-changing sheet.

Description of Flowchart in First Embodiment (Description of Main Flowchart for Sheet Feeding Process)

Figure 11:
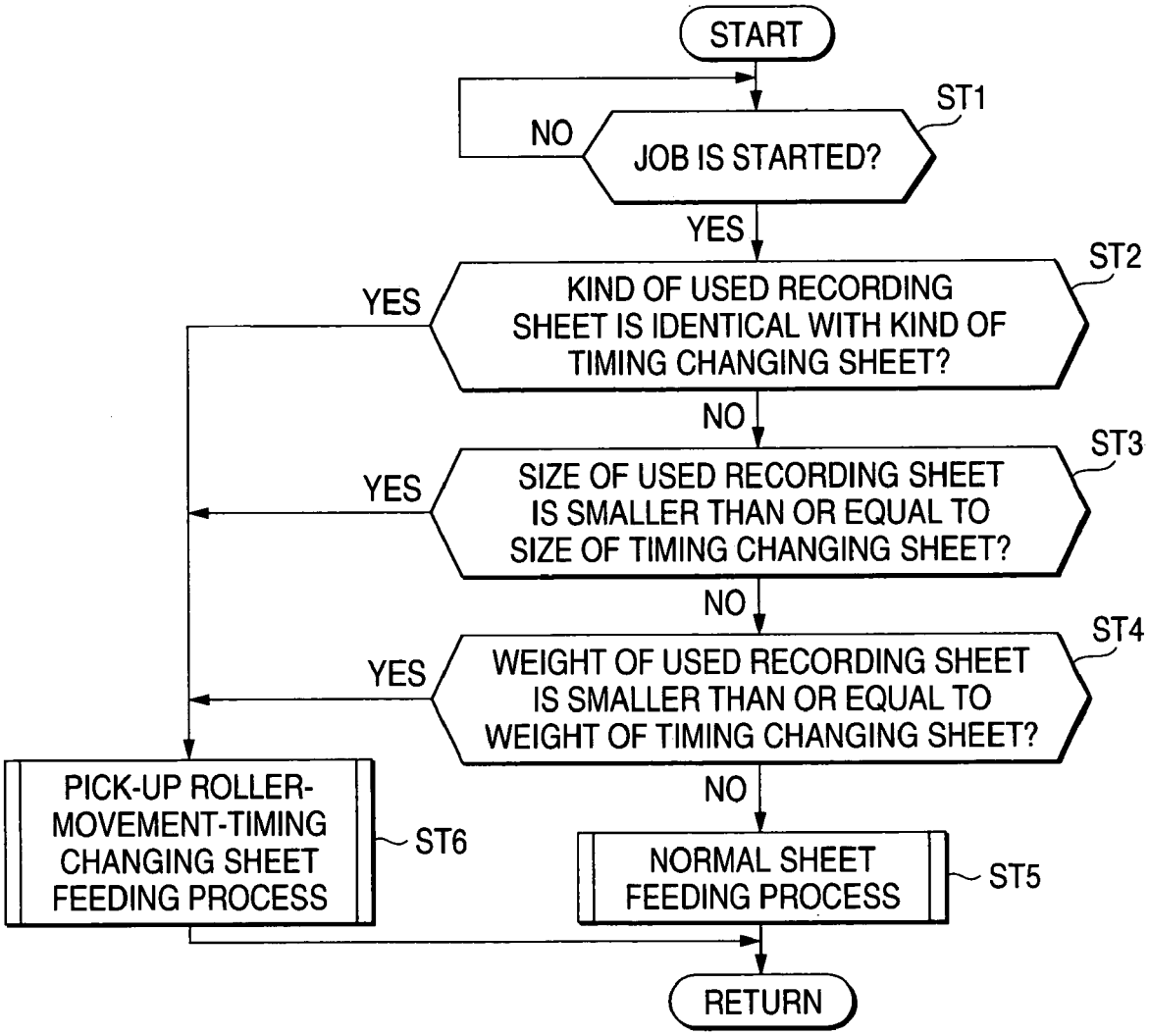
FIG. 11 is a main flowchart illustrating a sheet feeding process of the image forming apparatus according to the first embodiment.

FIG. 11 is a main flowchart illustrating a sheet feeding process of the image forming apparatus according to the first embodiment.

Respective steps ST of the flowchart in FIG. 11 are performed in accordance with the programs stored in the ROM or the hard disk of the controller C. The processes are performed as a multi-task along with other processes of the image forming apparatus U.

The flowchart shown in FIG. 11 is started when power is turned on.

In ST1 of FIG. 11, it is determined whether or not a job is started. When it is determined Yes (Y), ST2 is performed and when it is determined No (N), ST1 is repeated.

In ST2, it is determined whether or not a kind of a used recording sheet S is identical with the kind of the timing-changing sheet. When it is determined No (N), ST3 is performed and when it is determined Yes (Y), ST6 is performed.

In ST3, it is determined whether or not a size of the used recording sheet S is smaller than or equal to the size of the timing-changing sheet. When it is determined No (N), ST4 is performed and when it is determined Yes (Y), ST6 is performed.

In ST4, it is determined whether a weight of the used recording sheet S is smaller than or equal to the weight of the timing-changing sheet. When it is determined No (N), ST5 is performed and when it is determined Yes (Y), ST6 is performed.

In ST5, the normal sheet feed process (roller-movement-timing fixing mode (see the sub routine of FIG. 12 described later)) in which the roller movement timing is not changed is performed, and then the flowchart returns to ST1.

In ST6, the roller-movement-timing-changing sheet feeding process (roller-movement-timing changing mode (see the sub routine of FIG. 13 described later)) in which the roller movement timing is changed is performed and then, the flowchart returns to ST1.

(Description of Normal Sheet Feeding Process (Roller-Movement-Timing Fixing Mode))

Figure 12:
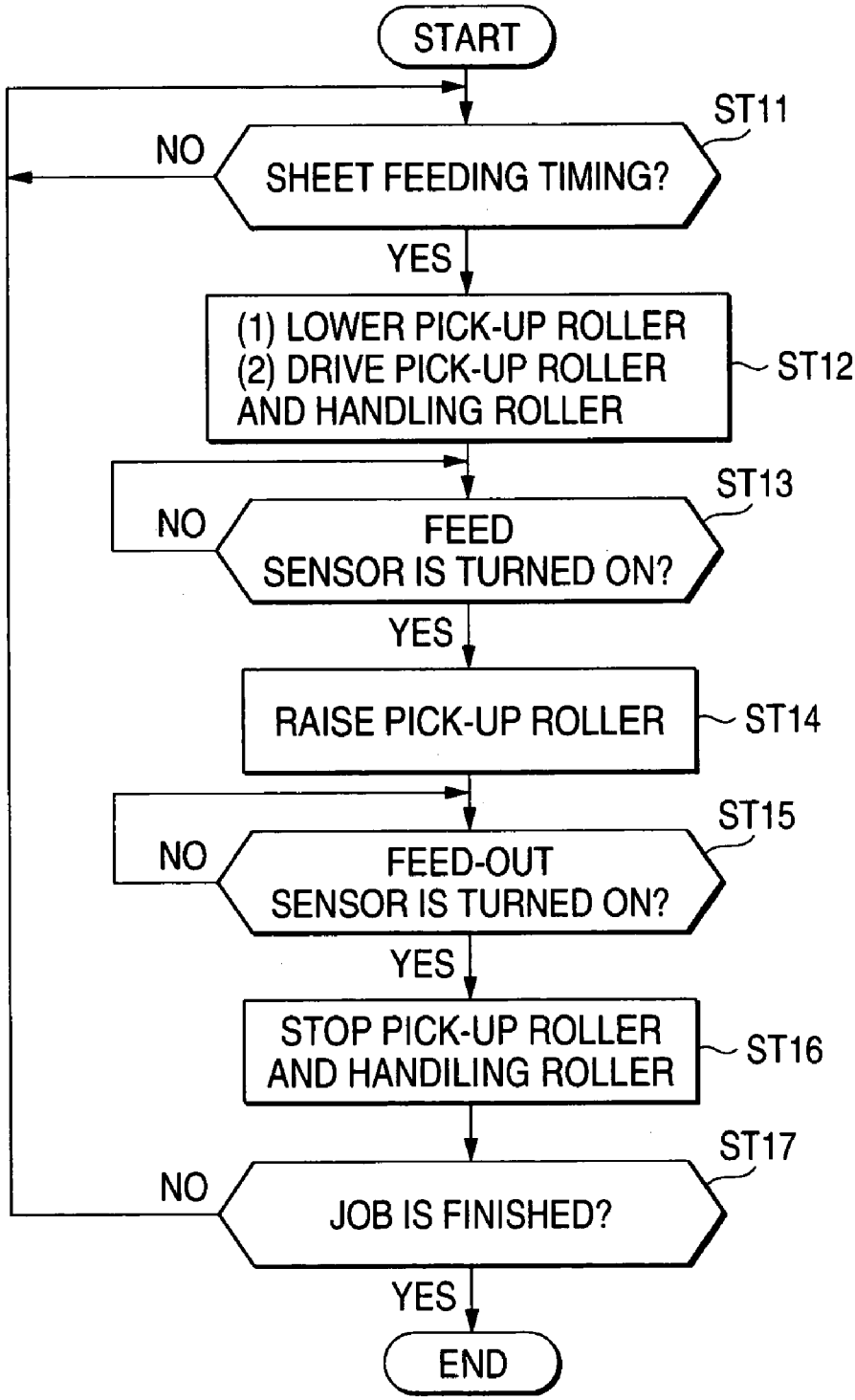
FIG. 12 is a flowchart illustrating a general sheet feeding process according to the first embodiment, which is a flowchart of a sub routine ST5 of FIG. 11.

FIG. 12 is a flowchart illustrating the normal sheet feeding process according to the first embodiment, in which the sub routine of ST5 of FIG. 11 is shown.

In ST11 of FIG. 12, the pick-up roller 41 is moved to the feeding position and it is then determined whether or not the sheet feeding start timing for feeding a sheet is reached. When it is determined No (N), ST11 is repeated and when it is determined Yes (Y), ST12 is performed.

In ST12, the following processes (1) and (2) are performed and then ST13 is performed:

(1) The solenoid 10 is turned on to move (lower) the pick-up roller 41 to the feeding position.

(2) The pick-up roller 41 and the handling roller (feed roller 24 and retard roller 42) are rotated.

In ST13, it is determined whether or not the feed sensor SN1 is turned on (whether or not the existence of a sheet is detected), that is, whether or not the front end of the recording sheet S is conveyed to the handling roller (24+42). When it is determined No (N), ST13 is repeated and when it is determined Yes (Y), ST14 is performed.

In ST14, the solenoid 10 is turned off to move (raise) the pick-up roller 41 to the feed standby position. Then, ST15 is performed.

In ST15, it is determined whether or not the feed-out sensor SN2 is turned on (whether or not the existence of a sheet is detected), that is, whether or not the front end of the recording sheet S is conveyed to the takeaway roller Ra. When it is determined No (N), ST15 is repeated and when it is determined Yes (Y), ST16 is performed.

In ST16, the driving handling roller (24+42) and the pick-up roller 41 is stopped. Then, ST17 is performed.

In ST17, it is determined whether or not the job is finished. When it is determined No (N), the flowchart returns to ST11 and when it is determined Yes (Y), the sub routine of FIG. 12 is finished. Then, the control returns to the main routine of FIG. 11.

(Description of Sheet Feeding Process in Which Pick-Up Roller Movement Timing is Changed (Roller-Movement-Timing Changing Mode))

Figure 13:
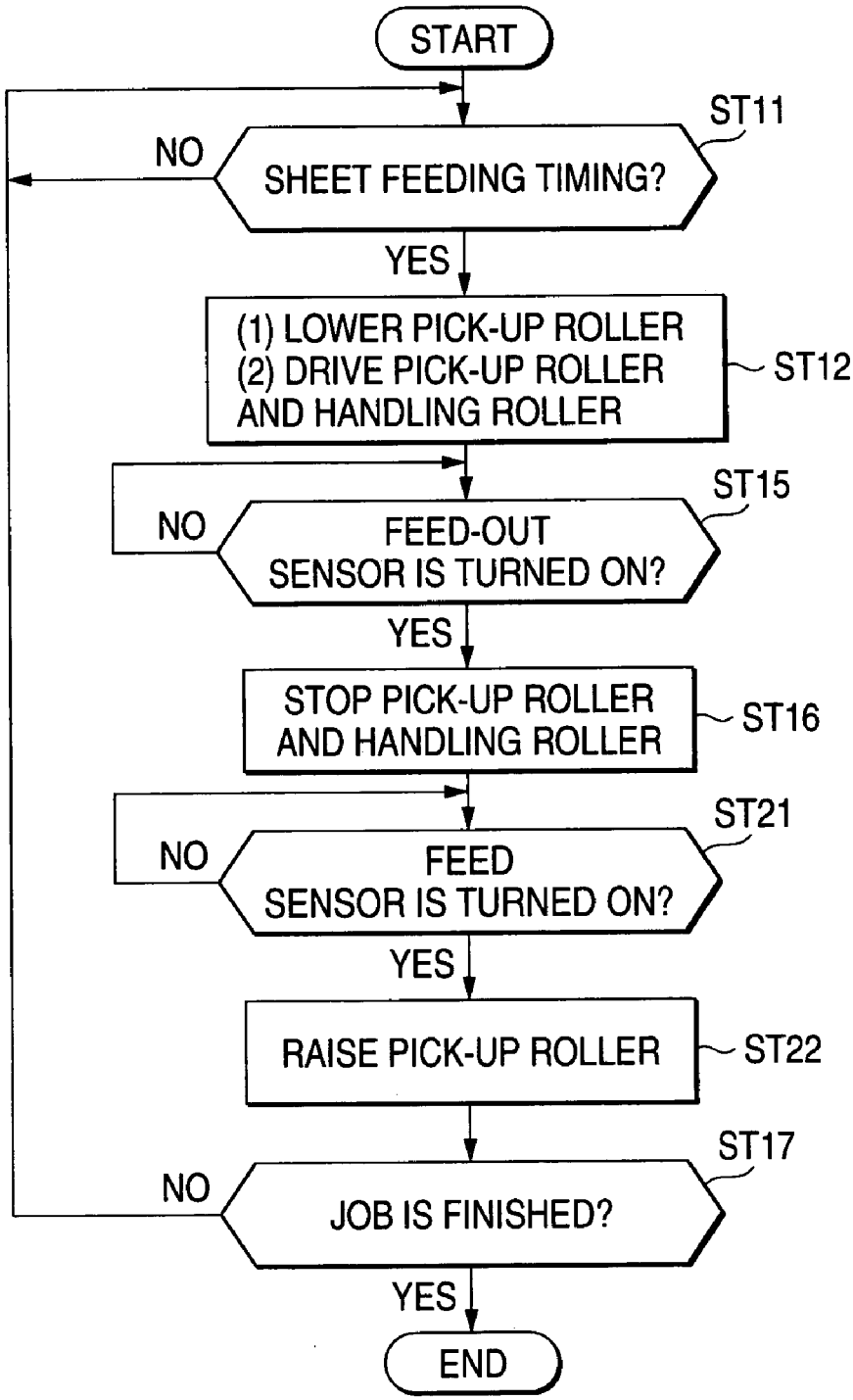
FIG. 13 is a flowchart illustrating a sheet feeding process in which a pick-up roller movement timing is changed according to the first embodiment, which is a flowchart of a sub routine ST6 of FIG. 11.

FIG. 13 is a flowchart of the sheet feeding process in which the pick-up roller movement timing is changed according to the first embodiment. The flowchart of FIG. 13 is the sub routine of ST6 shown in FIG. 11.

Although the flowchart of the sheet feeding process in which the pick-up roller movement timing is changed according to the first embodiment is next described, the same steps as the flowchart of the normal sheet feeding process are denoted by the same ST numbers and descriptions thereof are omitted.

In FIG. 13, the same steps as ST11 to ST12 of the normal sheet feeding process are performed and then ST15 is performed.

Next, the same steps as ST15 and ST16 of the normal sheet feeding process are performed and then ST21 is performed.

In ST21, it is determined whether or not the feed sensor SN1 is turned off (whether or not no sheet is detected), that is, whether or not the rear end of the recording sheet S passes through the feed roller 24. When it is determined No (N), ST21 is repeated and when it is determined Yes (Y), ST22 is performed.

In ST22, the solenoid 10 is turned off to move (raise) the pick-up roller 41 to the feed standby position. Then, ST17 is performed.

Operation of First Embodiment

In the manual sheet feeding device 6 serving as the sheet conveyance device according to the first embodiment having the above-mentioned configuration, when a used recording sheet S is the timing-changing sheet, the roller movement timing at which the pick-up roller 41 is moved to the feed standby position is changed. In the manual sheet feeding device 6 according to the first embodiment, when a used recording sheet S is the timing-changing sheet, that is, when the frictional coefficient between sheets is small, or when the size is small like the postcard, or when the weight of the recording sheet is small, the roller movement timing is changed.

When a plurality of recording sheets S are conveyed to the handling roller (24+42), the lower-side recording sheets S are handled by the retard roller 42 and then returned upstream. However, when a used recording sheet S is the timing-changing sheet, the frictional coefficient is small, or the size is small, or the weight is small. As a result, the recording sheet S can be easily moved and can be dragged by the uppermost recording sheet S to be conveyed downstream, so as to enter again the handling roller (24+42). However, in the manual sheet feeding device 6 according to the first embodiment, when the timing-changing sheet is used, the pick-up roller 41 is stopped and held at the feeding position to press the bundle of the recording sheets. As a result, it is possible to prevent the handled recording sheets S from entering again the handling roller (24+42). Therefore, the handling abnormal noises generated due to the repeated entering can be prevented.

As a result, in the manual sheet feeding device 6 according to the first embodiment 1, without using a particular member (pressing roller, etc.) pressing the recording sheets S and with a simple structure, it is possible to prevent the handled recording sheets from entering again the handling region (the region where the feed roller 24 and the retard roller 42 contact with each other). In the manual sheet feeding device 6 according to the first embodiment, when the rear end of the recording sheet S passes through the handling roller (24+42), the pick-up roller 41 is moved (raised) to the feed standby position. Accordingly, when a user replenishes recording sheets to the manual tray TR0, it is possible to prevent the pick-up roller 41 from interfering with the user's replenishment operation.

In addition, in the manual sheet feeding device 6 according to the first embodiment, in the case where a recording sheet S other than the timing-changing sheet, which can easily enter the handling region is used, since the pick-up roller 41 is moved (raised) to the feed standby position when the front end of the recording sheet S is conveyed to the handling roller (24+42) and the feed roller 24 conveys the recording sheet, it is possible to prevent the pick-up roller 41 from generating the conveyance resistance. As a result, in comparison with the case where the pick-up roller is always held at the feeding position during feeding sheets, it is possible to reduce the conveyance resistance and to reduce the wear of the pick-up roller 41, thereby improving the durability. In addition, it is also possible to suppress the power consumption of the solenoid 10.

Since the timing for raising the pick-up roller 41 is delayed when the timing-changing sheet is used, the feed interval cannot be shortened much. However, in the case where the recording sheets S other than the timing-changing sheet are used, since the pick-up roller 41 is raised to the feed standby position when the front end of the recording sheet S is conveyed to the handling roller (24+42), it is possible to shorten the feed interval and to enhance the productivity, in comparison with the case where the pick-up roller 41 is held at the feeding position for all the recording sheets S.

Second Embodiment

Next, a second embodiment of the invention will be described. In the description of the second embodiment, elements corresponding to the elements of the first embodiment are denoted by the same reference numerals and detailed description thereof is omitted. The second embodiment is different from the first embodiment in the following points, but the other points are equal to those of the first embodiment.

Description of Controller of Second Embodiment

Figure 14:
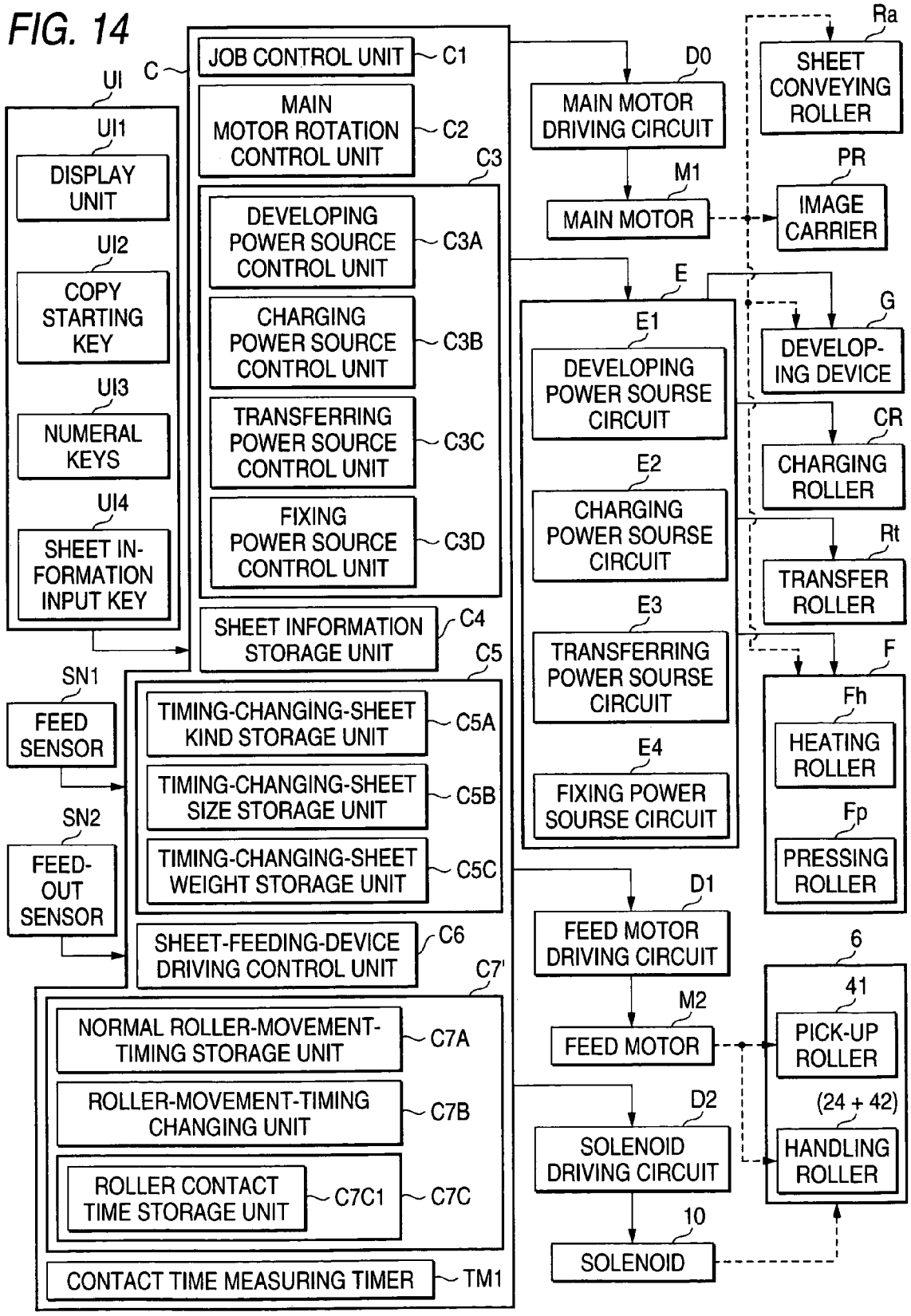
FIG. 14 is a block diagram (functional block diagram) illustrating functions of controllers of an image forming apparatus according to a second embodiment of the invention, which corresponds to FIG. 10 of the first embodiment.

FIG. 14 is a block diagram (function block diagram) illustrating the functions of control units of the image forming apparatus according to the second embodiment, which corresponds to FIG. 10 of the first embodiment.

Functions of Controller C of Second Embodiment

The controller C according to the second embodiment has a pick-up roller lifting control unit C7', instead of the pick-up roller lifting control unit C7 according to the first embodiment.

C7': Pick-Up Roller Lifting Control Unit

The pick-up roller lifting control unit C7' according to the second embodiment includes a roller contact time setting unit C7C and a contact time measuring timer TM1, in addition to the normal roller-movement-timing storage unit C7A and the roller-movement-timing changing unit C7B.

C7C: Roller Contact Time Setting Unit

The roller contact time setting unit C7C includes a roller contact time storage unit C7C1 that stores time for which the pick-up roller 41 held at the feeding position contacts the recording sheet S (roller contact time) for each size of the recording sheets in a case where the timing-changing sheet is used. The roller contact time setting unit C7C sets the roller contact time t1 corresponding to the size of the used recording sheet S on the basis of the roller contact time stored in the roller contact time storage unit C7C1. The roller contact time storage unit C7C1 according to the second embodiment stores the time from after the front end of the recording sheet S is conveyed to the handling roller 24+42 to just before the rear end passes through the handling roller (24+42), as the roller contact time.

TM1: Contact Time Measuring Timer

The contact time measuring timer TM1 measures time so as to check whether the roller contact time t1 set by the roller contact time setting unit C7C passes.

Description of Flowchart of Second Embodiment (Description of Flowchart of Sub Routine of Sheet Feeding Process in Which Pick-Up Roller Movement Timing is Changed)

Figure 15:
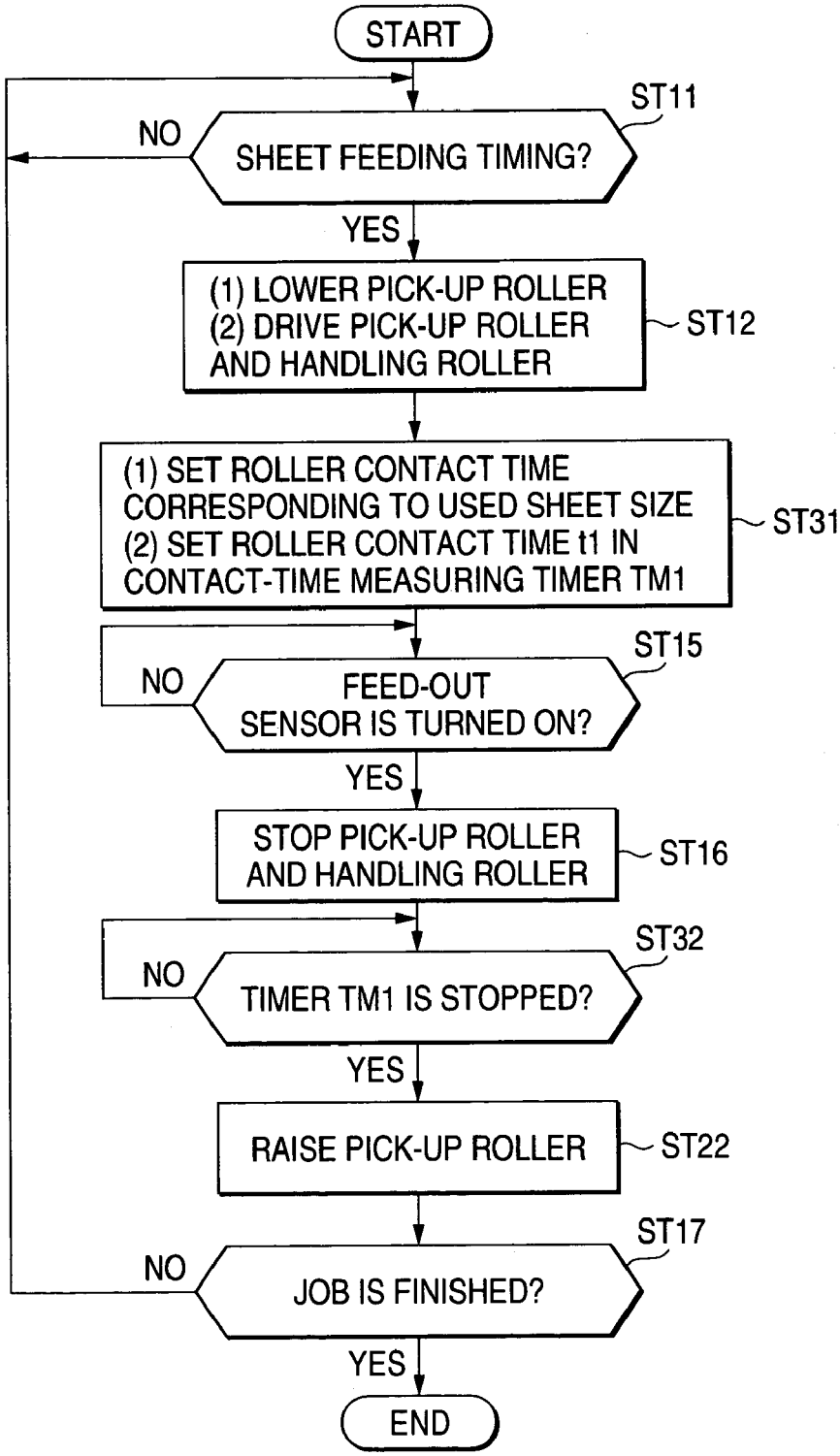
FIG. 15 is a flowchart illustrating a sub routine of a sheet feeding process in which a pick-up roller movement timing is changed according to the second embodiment, which corresponds to FIG. 13 of the first embodiment.

FIG. 15 is a flowchart illustrating a sub routine of the sheet feeding process in which the pick-up roller movement timing is changed according to the second embodiment, which corresponds to FIG. 13 of the first embodiment.

Next, the flowchart according to the second embodiment will be described. The same steps as the flowchart of the first embodiment are denoted by the same ST numbers and detailed description thereof will be omitted.

In FIG. 15, the same steps as ST11 to ST12 of the normal sheet feeding process according to the first embodiment are performed and then ST31 is performed.

In ST31, the following processes (1) and (2) are performed and then ST15 is performed:

(1) The roller contact time t1 is set to correspond to the size of the used recording sheet; and (2) The set roller contact time t1 is set to the contact time measuring timer TM1.

Next, the same steps as ST15 and ST16 of the normal sheet feeding process are performed and then ST32 is performed.

In ST32, it is determined whether or not the contact time measuring timer TM1 is finished, that is, whether or not the rear end of the recording sheet S passes through the feed roller 24. When it is determined No (N), ST32 is repeated and when it is determined Yes (Y), ST22 is performed.

Next, ST22 and ST17 are performed.

Operation of Second Embodiment

In the manual sheet feeding device 6 as the sheet conveyance device according to the second embodiment having the above-mentioned construction, the pick-up roller 41 is moved (raised) to the feed standby position on the basis of the roller contact time t1, not on the basis of the detection of the existence of the recording sheet by the feed sensor SN1. In the manual sheet feeding device 6 according to the second embodiment, since the time right before the rear end of the recording sheet S passes through the handling roller (24+42) is set as the roller contact time t1, the timing for moving the pick-up roller 41 to the feed standby position is faster than that of the first embodiment. Therefore, it is possible to further shorten the feed interval in comparison with the manual sheet feeding device 6 according to the first embodiment. Otherwise, the manual sheet feeding device 6 according to the second embodiment has the same operations and advantages as the manual sheet feeding device 6 according to the first embodiment.

Third Embodiment

Next, a third embodiment of the invention will be described. In the description of the third embodiment, the elements corresponding to the elements of the first embodiment are denoted by the same reference numerals and detailed description thereof will be omitted. The third embodiment is different from the first embodiment in the following points, but the other points are equal to those of the first embodiment.

Description of Controller of Third Embodiment

Figure 16:
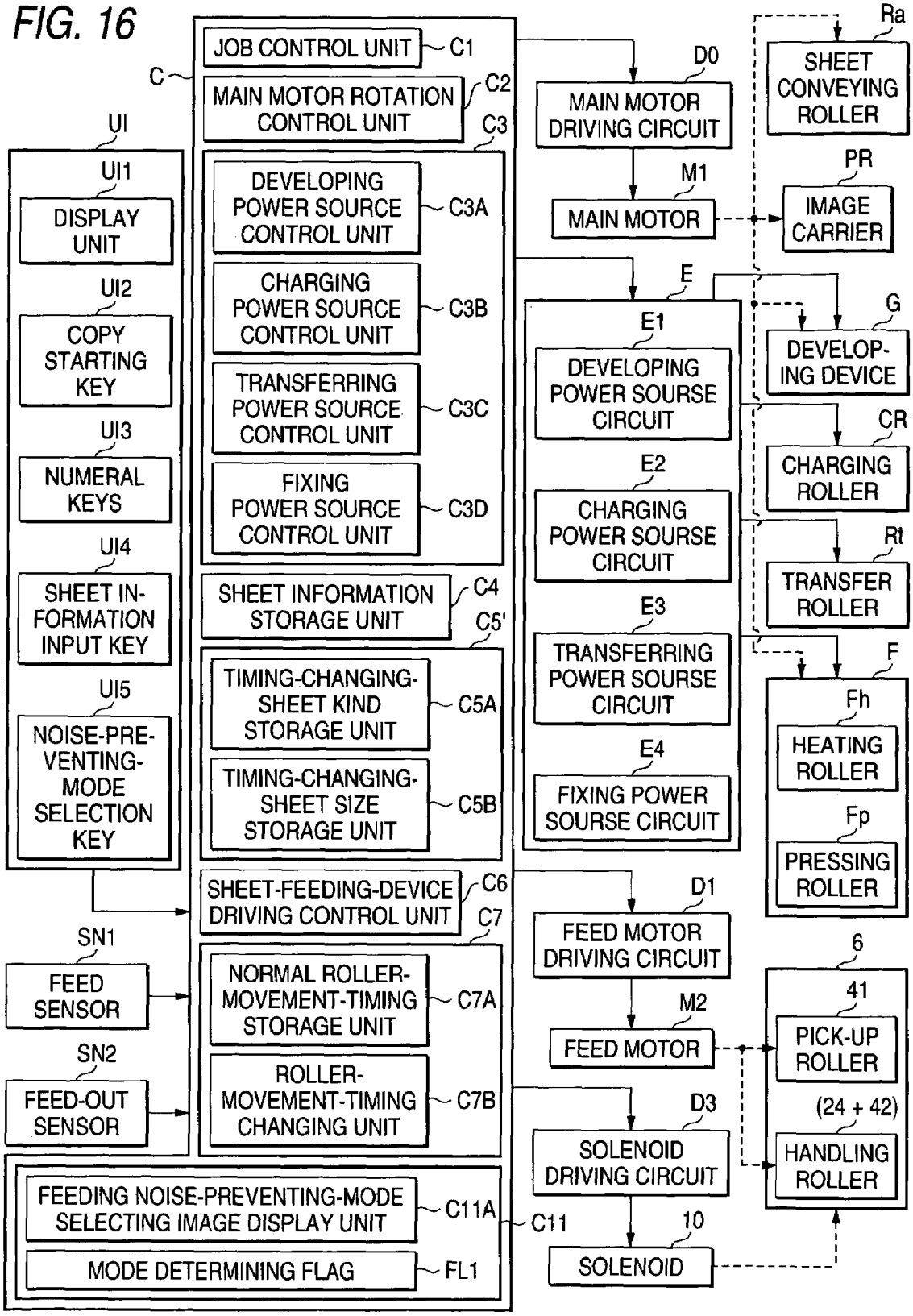
FIG. 16 is a block diagram (functional block diagram) illustrating functions of controllers of an image forming apparatus according to a third embodiment of the invention, which corresponds to FIG. 10 of the first embodiment.

FIG. 16 is a block diagram (function block diagram) illustrating the functions of control units of the image forming apparatus according to the third embodiment, which corresponds to FIG. 10 of the first embodiment.

Signal Input Elements Connected to Controller C of Third Embodiment

In FIG. 16, a user interface (UI) according to the third embodiment has a noise-preventing-mode selection key UI5.

Functions of Controller C of Third Embodiment

The controller C according to the third embodiment includes a timing changing determining unit C5' in which the timing-changing-sheet weight storage unit C5C is omitted, instead of the timing changing determining unit C5 of the controller C according to the first embodiment. That is, the timing changing determining unit C5' according to the third embodiment determines whether or not the used recording sheet S is the timing-changing sheet on the basis of the kind and size of the sheet as the sheet information.

The controller C according to the third embodiment has the following functions, in addition to the functions (control units) of the controller C of the first embodiment.

C11: Mode Switching Unit

The mode switching unit C11 includes a feeding noise-preventing-mode selecting image display unit C11A and a mode determining flag FL1. The mode switching unit C11 switches between a roller-movement-timing changing mode in which the roller movement timing is changed and a roller-movement-timing fixing mode in which the roller movement timing is not changed, in accordance with a user's input.

Figure 17:
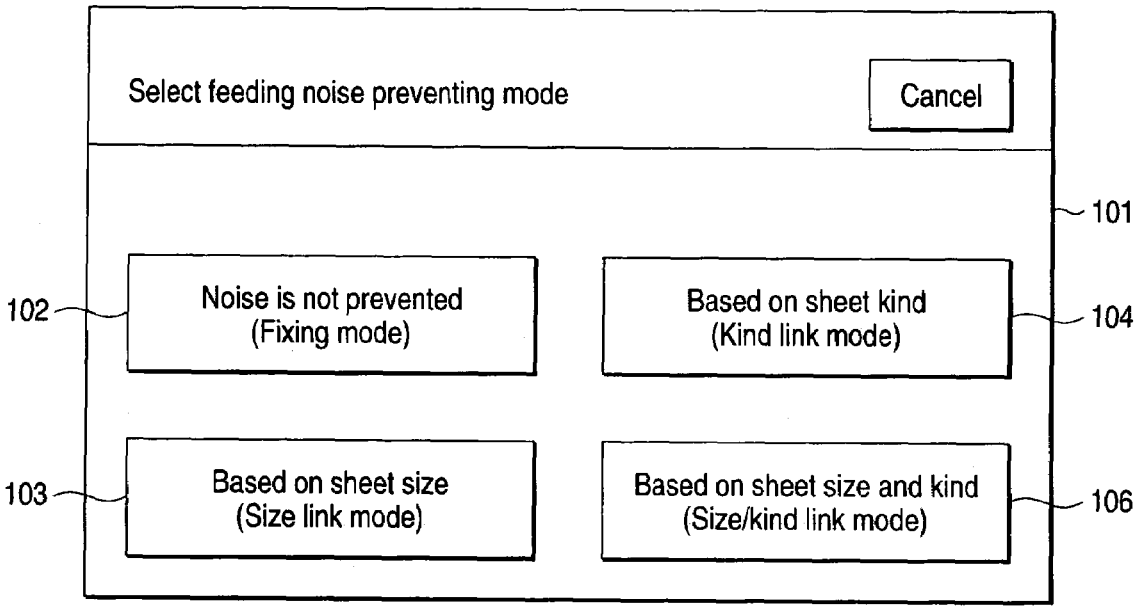
FIG. 17 is an explanatory diagram illustrating a noise-preventing-mode selecting image according to the third embodiment.

FIG. 17 is an explanatory diagram illustrating the noise-preventing-mode selecting image according to the third embodiment.

C11A: Feeding Noise-Preventing-Mode Selecting Image Display Unit

The feeding noise-preventing-mode selecting image display unit C11A displays a noise-preventing-mode selecting image 101 (see FIG. 17) on the display unit UI1 in accordance with the input through the noise-preventing-mode setting key UI5. In FIG. 17, the noise-preventing-mode selecting image 101 of the third embodiment includes a fixing-mode selecting icon 102, size-link-mode selecting icon 103, a kind-link-mode selecting icon 104, and a size/kind-link-mode selecting icon 106. The fixing-mode selecting icon 102 is used for selecting the fixing mode (roller-movement-timing fixing mode) in which the pick-up roller-movement-timing-changing sheet feeding process for preventing the generation of noises by changing the roller movement timing is not performed. The size-link-mode selecting icon 103 is used for selecting a size link mode in which the pick-up roller-movement-timing-changing sheet feeding process is performed according to a size of the recording sheet. The kind-link-mode selecting icon 104 is used for selecting a kind link mode in which the pick-up roller-movement-timing-changing sheet feeding process is performed according to a kind of the recording sheet. The size/kind-link-mode selecting icon 106 is used for selecting a size/kind link mode in which the pick-up roller-movement-timing-changing sheet feeding process is performed according to a sized and a kind of of the recording sheet.

FL1: Mode Determining Flag

The mode determining flag FL1 has an initial value of "00." The value is "00" when the fixing mode is selected in the noise-preventing-mode selecting image 101, "01" when the size link mode is selected, "10" when the kind link mode is selected, and "11" when the size and kind link mode is selected.

Description of Flowchart of Third Embodiment

Next, the flowchart according to the third embodiment will be described. The same steps as the flowchart according to the first embodiment are denoted by the same ST numbers and detailed description thereof will be omitted.

(Noise-Preventing-Mode Selecting Process)

Figure 18:
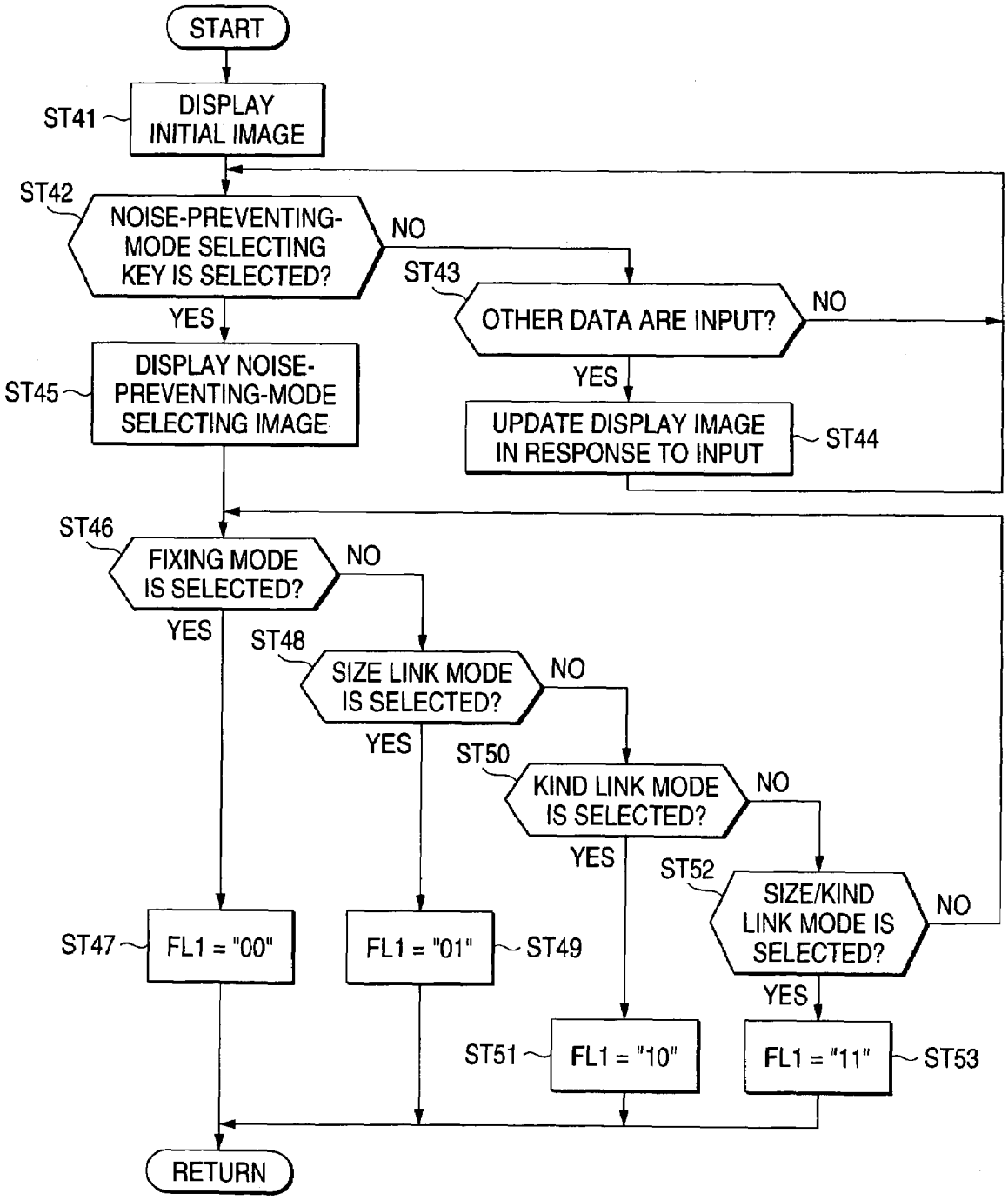
FIG. 18 is a flowchart illustrating a noise-preventing-mode selecting process according to the third embodiment.

FIG. 18 is a flowchart illustrating the noise-preventing-mode selecting process according to the third embodiment.

The process shown in FIG. 18 is performed along with other processes of the image forming apparatus U.

The flowchart shown in FIG. 18 is started by turning on the image forming apparatus U.

In ST41 of FIG. 18, the display unit UI1 of the user interface UI displays an initial image through which the number of copies, etc. can be input. Then, ST42 is performed.

In ST42, it is determined whether or not the noise-preventing-mode selecting key UI5 is pushed. When it is determined No (N), ST43 is performed and when it is determined Yes (Y), ST45 is performed.

In ST43, it is determined whether or not other inputs are carried out (whether or not the copy start key UI2, the numeral key UI3, or the sheet information input key UI4 is pushed). When it is determined Yes (Y), ST44 is performed and when it is determined No (N), ST42 is performed again.

In ST44, the display image on the display unit UI1 is updated in response to the input.

In ST45, the noise-preventing-mode selecting image 101 (see FIG. 17) is displayed on the display unit UI1. Then, ST46 is performed.

In ST46, it is determined whether or not the fixing mode selecting icon 102 is selected. When it is determined Yes (Y), ST47 is performed and when it is determined No (N), ST48 is performed.

In ST47, the mode determining flag FL1 is set to "00." Then, the flowchart is returns to ST41.

In ST48, it is determined whether or not the size-link-mode selecting icon 103 is selected. When it is determined Yes (Y), ST49 is performed and when it is determined No (N), ST50 is performed.

In ST49, the mode determining flag FL1 is set to "01." Then, the flowchart returns to ST41.

In ST50, it is determined whether or not the kind-link-mode selecting icon 104 is selected. When it is determined Yes (Y), ST51 is performed and when it is determined No (N), ST52 is performed.

In ST51, the mode determining flag FL1 is set to "10." Then, the flowchart returns to ST41.

In ST52, it is determined whether or not the size/kind-link-mode selecting icon 106 is selected. When it is determined Yes (Y), ST53 is performed and when it is determined No (N), ST46 is performed again.

In ST53, the mode determining flag FL1 is set to "11." Then, the flowchart returns to ST41.

(Description of Main Flowchart of Sheet Feeding Process)

Figure 19:
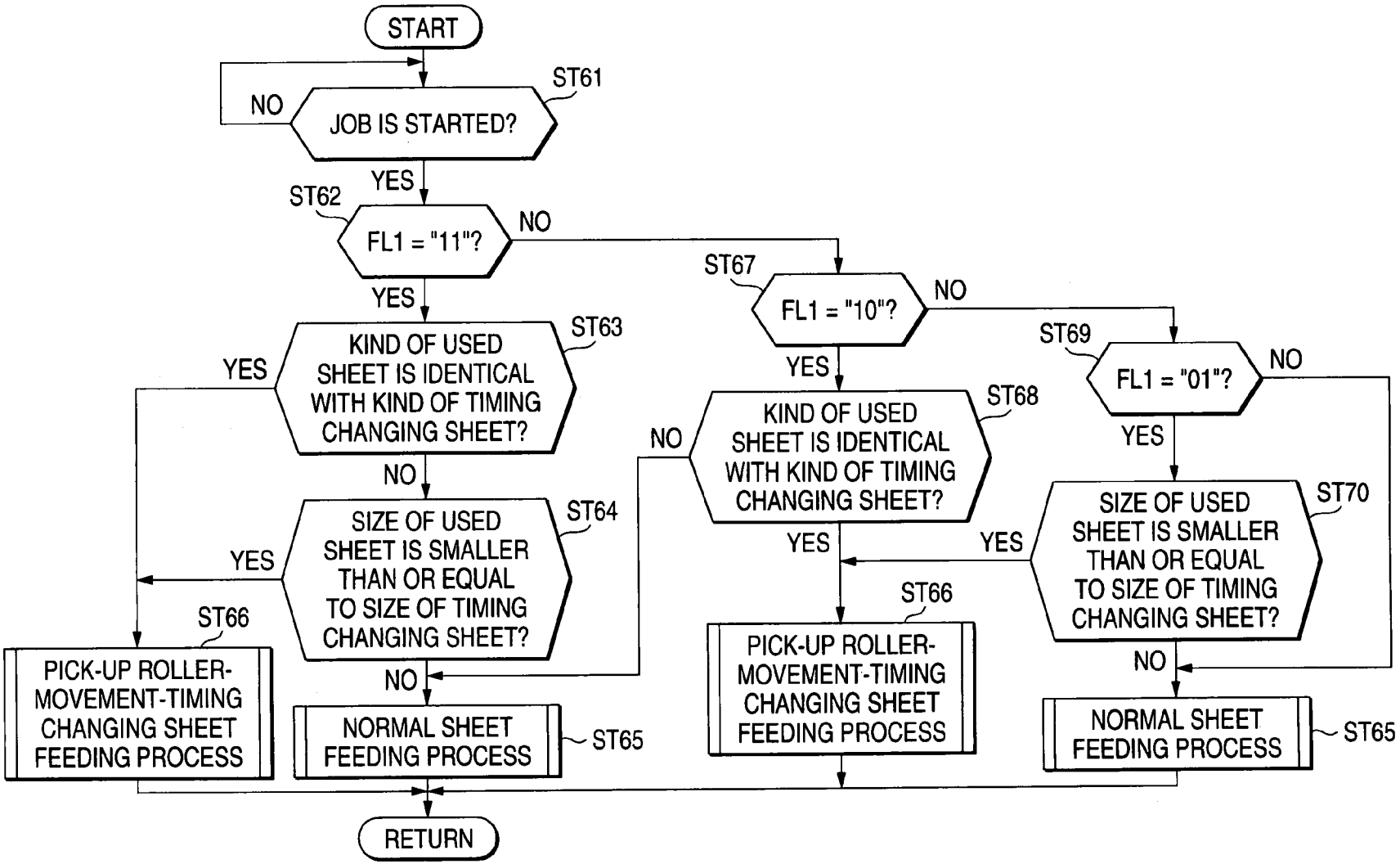
FIG. 19 is a main flowchart illustrating a sheet feeding process according to the third embodiment, which corresponds to FIG. 11 of the first embodiment.

FIG. 19 is a main flowchart illustrating the sheet feeding process according to the third embodiment, which corresponds to FIG. 11 of the first embodiment.

The process shown in FIG. 19 is started by turning on the image forming apparatus U.

In ST61 of FIG. 19, it is determined whether or not a job is started. When it is determined No (N), ST61 is repeated and when it is determined Yes (Y), ST62 is performed.

In ST62, it is determined whether as to the mode determining flag FL1 is "11." When it is determined Yes (Y), ST63 is performed and when it is determined No (N), ST67 is performed.

In ST63, it is determined whether or not the kind of the used recording sheet S is identical with the kind of timing-changing sheet. When it is determined No (N), ST64 is performed and when it is determined Yes (Y), ST66 is performed.

In ST64, it is determined whether or not the size of the used recording sheet S is smaller than or equal to the size of the timing-changing sheet. When it is determined No (N), ST65 is performed and when it is determined Yes (Y), ST66 is performed.

In ST65, the normal sheet feeding process (see the sub routine shown in FIG. 12) such as ST5 in the first embodiment is performed and then the flowchart returns to ST61.

In ST66, the pick-up roller-movement-timing-changing sheet feeding process (see the sub routing shown in FIG. 13) such as ST6 in the first embodiment is performed and then the flowchart returns to ST61.

In ST67, it is determined whether or not the mode determining flag FL1 is "10." When it is determined Yes (Y), ST68 is performed and when it is determined No (N), ST69 is performed.

In ST68, it is determined whether or not the kind of the used recording sheet S is identical with the kind of the timing-changing sheet. When it is determined No (N), ST65 is performed and when it is determined Yes (Y), ST66 is performed.

In ST69, it is determined whether or not the mode determining flag FL1 is "01." When it is determined Yes (Y), ST70 is performed and when it is determined No (N), ST65 is performed.

In ST70, it is determined whether or not the size of the used recording sheet S is smaller than or equal to the size of the timing-changing sheet. When it is determined No (N), ST65 is performed and when it is determined Yes (Y), ST66 is performed.

Operation of Third Embodiment

In the manual sheet feeding device 6 serving as the sheet conveyance device according to the third embodiment having the above-mentioned construction, the fixing mode in which the pick-up roller-movement-timing-changing sheet feeding process is not performed can be selected by means of the input by a user, regardless of the size or the kind of the recording sheet. The size link mode for performing the pick-up roller-movement-timing-changing sheet feeding process on the basis of only the sheet size regardless of the sheet kind, the kind link mode for performing the process on the basis of only the sheet kind regardless of the sheet size, and the size and kind link mode for performing the process on the basis of the sheet size and the sheet kind can be switched by means of the input by a user.

Therefore, in the manual sheet feeding device 6 according to the third embodiment, a user can select a function of preventing the noises or a function of shortening the feed interval in preference to preventing the noises. In addition, the manual sheet feeding device 6 according to the third embodiment has the same advantages as the manual sheet feeding device 6 according to the first embodiment.

MODIFIED EXAMPLE

Hitherto, the embodiments of the invention have been described in detail. However, the invention is not limited to the embodiments described above, but can be variously modified without departing from the gist of the invention described in the appended claims. Modified examples (H01) to (H010) of the invention will be described now.

(H01) The invention is not limited to the copier, but is applicable to image forming apparatuses such as printers, facsimiles, and multi-function machines. The invention is not limited to a full-color image forming apparatus, but is applicable to a monochrome image forming apparatus. The invention is not limited to an electrophotographic image forming apparatus, but is applicable to image forming apparatuses of different record types such as an inkjet recording type.

(H02) Although the manual sheet feeding device 6 has been exemplified as the sheet conveyance device in the embodiments, the invention is not limited to the manual tray, but is applicable to the document feeding tray TG1 of the automatic document feeder U2.

(H03) The construction for lifting the pick-up roller 41 is not limited to the construction described in the embodiments, but can employ various known constructions or mechanisms.

(H04) Although the timing-changing sheet has been identified on the basis of kind and size of the sheet in the third embodiment, the timing-changing sheet may be identified on the basis of weight of the sheet.

(H05) The kind of a timing-changing sheet, the size of a timing-changing sheet, and the weight of a timing-changing sheet are not limited to the values of the kind, size, and weight exemplified in the above-mentioned embodiments, but can be changed in design of the type of the image forming apparatus U. As the values, the length of a sheet in the conveyance direction (for example, 210 mm, etc.) can be used instead of the size of a sheet such as A4 or B5 and density can be used instead of the weight of a sheet.

(H06) The roller movement timing has been changed in the first and second embodiments when it belongs to the kind of the timing-changing sheet, or when it is smaller than or equal to the size of the timing-changing sheet, or when it is smaller than the weight of the timing-changing sheet. However, the invention is not limited to it, but the roller movement timing may be changed, for example, when it belongs to the kind of the timing-changing sheet and is smaller than or equal to the size of the timing-changing sheet. Alternatively, the roller movement timing may be changed only when it belongs to the kind of a timing-changing sheet, is smaller than or equal to the size of the timing-changing sheet, and is smaller than the weight of the timing-changing sheet.

(H07) The selection of a mode has been performed by means of the input from the user interface in the third embodiment. However, the invention is not limited to it, but the selection of a mode may be performed by means of a deep switch, a jumper pin, or the like. It is also possible that the user is not allowed to select the mode but a service engineer may be allowed to set the mode at the time of shipping.

(H08) Although the time just until the rear end passes through the handling roller 24+42 has been used as the roller contact time in the second embodiment, the roller contact time may be set to the proper time before or after the rear end passes through the handling roller 24+42. When the roller contact time is set smaller, the feed interval can be shortened in comparison with the second embodiment but noises may occur more easily. However, the time when the noises occur can be shortened, in comparison with the related arts.

(H09) Although the roller contact time t1 is stored in advance in accordance with the sizes of recording sheets in the second embodiment, it may be manually set by means of the input of a user. The roller contact time t1 maybe set constant, regardless of the sizes of the recording sheets.

(H010) Although the activation timing and the deactivation timing of the pick-up roller 41, the feed roller 24, and the retard roller 42 are equal to each other in the embodiments, the invention is not limited to such a case. For example, a clutch may be disposed in the pick-up roller 41 and only the pick-up roller 41 may be deactivated when the front end of a recording sheet reaches the feed roller 24 and the retard roller 42.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

FIG. 10 (Part A)
U user interface
UI1 display unit
UI2 copy starting key
UI3 numeral keys
UI4 sheet information input key
SN1 feed sensor
SN2 feed-out sensor
C controller
C1 job control unit
C2 main motor rotation control unit
C3 power source circuit control unit
C3A developing power source control unit
C3B charging power source control unit
C3C transferring power source control unit
C3D fixing power source control unit
C4 sheet information storage unit
C5 timing changing determining unit
C5A timing-changing-sheet kind storage unit
C5B timing-changing-sheet size storage unit
C5C timing-changing-sheet weight storage unit
C6 sheet-feeding-device driving control unit
C7 pick-up roller lifting control unit
C7A normal roller-movement-timing storage unit
C7B roller-movement-timing changing unit
D0 main motor driving circuit
D1 feed motor driving circuit
D2 solenoid driving circuit
M1 main motor
M2 feed motor
Ra sheet conveying roller
PR image carrier
FIG. 10 (part B)
G developing device
CR charging roller
Rt transfer roller
F fixing device
Fh heating roller
Fp pressing roller
E power source circuit
E1 developing power source circuit
E2 charging power source circuit
E3 transferring power source circuit
E4 fixing power source circuit
6 manual sheet feeding device
41 pick-up roller
(24+42) handling roller
10 solenoid
FIG. 11
ST1: IS JOB STARTED?
ST2: IS KIND OF USED RECORDING SHEET IDENTICAL WITH KIND OF TIMING CHANGING SHEET?
ST3: IS SIZE OF USED RECORDING SHEET SMALLER THAN OR EQUAL TO SIZE OF TIMING CHANGING SHEET?
ST4: IS WEIGHT OF USED RECORDING SHEET SMALLER THAN OR EQUAL TO WEIGHT OF TIMING CHANGING SHEET?
ST5: NORMAL SHEET FEEDING PROCESS
ST6: PICK-UP ROLLER-MOVEMENT-TIMING CHANGING SHEET FEEDING PROCESS
FIG. 12
ST11: SHEET FEEDING TIMING?
ST12: (1) LOWER PICK-UP ROLLER
(2) DRIVE PICK-UP ROLLER AND HANDLING ROLLER
ST13: IS FEED SENSOR TURNED ON?
ST14: RAISE PICK-UP ROLLER
ST15: IS FEED-OUT SENSOR TURNED ON?
ST16: STOP PICK-UP ROLLER AND HANDLING ROLLER
ST17: IS JOB FINISHED?

FIG. 13
ST11: SHEET FEEDING TIMING?
ST12: (1) LOWER PICK-UP ROLLER
(2) DRIVE PICK-UP ROLLER AND HANDLING ROLLER
ST15: IS FEED-OUT SENSOR TURNED ON?
ST16: STOP PICK-UP ROLLER AND HANDLING ROLLER
ST21: IS FEED SENSOR TURNED ON?
ST22: RAISE PICK-UP ROLLER
ST17: IS JOB FINISHED?
FIG. 14 (part A)
U user interface
UI1 display unit
UI2 copy starting key
UI3 numeral keys
UI4 sheet information input key
SN1 feed sensor
SN2 feed-out sensor
C controller
C1 job control unit
C2 main motor rotation control unit
C3 power source circuit control unit
C3A developing power source control unit
C3B charging power source control unit
C3C transferring power source control unit
C3D fixing power source control unit
C4 sheet information storage unit
C5 timing changing determining unit
C5A timing-changing-sheet kind storage unit
C5B timing-changing-sheet size storage unit
C5C timing-changing-sheet weight storage unit
C6 sheet-feeding-device driving control unit
C7' pick-up roller lifting control unit
C7A normal roller-movement-timing storage unit
C7B roller-movement-timing changing unit
C7C roller contact time setting unit
C7C1 roller contact time storage unit
TM1 contact time measuring timer
D0 main motor driving circuit
D1 feed motor driving circuit
D2 solenoid driving circuit
FIG. 14 (part B)
M1 main motor
M2 feed motor
Ra sheet conveying roller
PR image carrier
G developing device
CR charging roller
Rt transfer roller
F fixing device
Fh heating roller
Fp pressing roller
E power source circuit
E1 developing power source circuit
E2 charging power source circuit
E3 transferring power source circuit
E4 fixing power source circuit

6 manual sheet feeding device
41 pick-up roller
(24+42) handling roller
10 solenoid
FIG. 15
ST11: SHEET FEEDING TIMING?
ST12: (1) LOWER PICK-UP ROLLER
(2) DRIVE PICK-UP ROLLER AND HANDLING ROLLER
ST31: (1) SET ROLL CONTACT TIME CORRESPONDING TO USED SHEET SIZE
(2) SET ROLLER CONTACT TIME t1 IN CONTACT-TIME MEASURING TIMER TM1
ST15: IS FEED-OUT SENSOR TURNED ON?
ST16: STOP PICK-UP ROLLERAND HANDLING ROLLER
ST32: IS TIMER TM1 STOPPED?
ST22: RAISE PICK-UP ROLLER
ST17: IS JOB FINISHED?
FIG. 16 (part A)
U user interface
UI1 display unit
UI2 copy starting key
UI3 numeral keys
UI4 sheet information input key
SN1 feed sensor
SN2 feed-out sensor
C controller
C1 job control unit
C2 main motor rotation control unit
C3 power source circuit control unit
C3A developing power source control unit
C3B charging power source control unit
C3C transferring power source control unit
C3D fixing power source control unit
C4 sheet information storage unit
C5' timing changing determining unit
C5A timing-changing-sheet kind storage unit
C5B timing-changing-sheet size storage unit
C6 sheet-feeding-device driving control unit
C7 pick-up roller lifting control unit
C7A normal roller-movement-timing storage unit
C7B roller-movement-timing changing unit
C11 mode switching unit
C11A feeding noise-preventing-mode selecting image display unit
FL1 mode determining flag
TM1 contact time measuring timer
D0 main motor driving circuit
D1 feed motor driving circuit
D2 solenoid driving circuit
FIG. 16 (part B)
M1 main motor
M2 feed motor
Ra sheet conveying roller
PR image carrier
G developing device
CR charging roller
Rt transfer roller
F fixing device
Fh heating roller
Fp pressing roller
E power source circuit
E1 developing power source circuit
E2 charging power source circuit
E3 transferring power source circuit
E4 fixing power source circuit

6 manual sheet feeding device
41 pick-up roller
(24+42) handling roller
10 solenoid
FIG. 17
102: NOISE IS NOT PREVENTED (FIXING MODE)
103: BASED ON SHEET SIZE (SIZE LINK MODE
104: BASED ON SHEET KIND (KIND LINK MODE)
106: BASED ON SHEET SIZE AND KIND (SIZE/KIND LINK MODE)
FIG. 18
ST41: DISPLAY INITIAL IMAGE
ST42: IS NOISE-PREVENTING-MODE SELECTING KEY SELECTED?
ST43: ARE OTHER DATA INPUT?
ST44: UPDATE DISPLAY IMAGE IN RESPONSE TO INPUT
ST45: DISPLAY NOISE-PREVENTING-MODE SELECTING IMAGE
ST46: IS FIXING MODE SELECTED?
ST47: FL1="00"
ST48: IS SIZE LINK MODE SELECTED?
ST49: FL1="01"
ST50: IS KIND LINK MODE SELECTED?
ST51: FL1="10"
ST52: IS SIZE/KIND LINK MODE SELECTED?
ST53: FL1="11"
FIG. 19
ST61: IS JOB STARTED?
ST62: FL1="11"?
ST63: IS KIND OF USED SHEET IDENTICAL WITH KIND OF TIMING CHANGING SHEET?
ST64: IS SIZE OF USED SHEET SMALLER THAN OR EQUAL TO SIZE OF TIMING CHANGING SHEET?
ST65: NORMAL SHEET FEEDING PROCESS
ST66: PICK-UP ROLLER-MOVEMENT-TIMING CHANING SHEET FEDDING PROCESS
ST67: FL1="10"?
ST68: IS KIND OF USED SHEET IDENTICAL WITH KIND OF TIMING CHANGING SHEET?
ST69: IS SIZE OF SHEET IN USE SMALLER THAN OR EQUAL TO SIZE OF TIMING CHANGING SHEET?

What is claimed is:

1. A sheet conveyance device comprising:

a pick-up roller that is movable between a feeding position where a recording sheet stacked in a sheet tray is fed and a feed standby position where the pick-up roller is separated from the recording sheet;

a handling member disposed on downstream of the pick-up roller in a sheet conveyance direction, the handling member separating the recording sheet fed by the pick-up roller one by one and conveying the separated recording sheet;

a locking member that is rotatable and comprises a cylindrical portion, a protruding portion and an abutting portion, wherein the cylindrical portion has a same rotation axis as the pick-up roller, the protruding portion protrudes from an outer circumferential surface of the cylindrical portion, the abutting portion is formed on the outer circumferential surface of the cylindrical portion, and the abutting portion is disposed between the pick-up roller and the handling member; and a roller-movement-timing changing unit that changes roller movement timing at which the pick-up roller is moved from the feeding position to the feed standby position, in accordance with a sheet information of a used recording sheet wherein the abutting portion abuts against a front end of the recording sheet in the sheet conveyance direction to prevent movement of the recording sheet in the sheet conveyance direction so as to position the front end of the recording sheet at a given position in a locked state.

2. The sheet conveyance device according to claim 1, wherein the sheet tray is a manual feed tray.

3. The sheet conveyance device according to claim 1, wherein when the used recording sheet is a timing-changing sheet, which is conveyed while changing the roller movement timing, the roller-movement-timing changing unit delays the roller movement timing in comparison with the roller movement timing for a sheet other than the timing-changing sheet.

4. The sheet conveyance device according to claim 1, wherein when the used recording sheet is a timing-changing sheet, which is conveyed while changing the roller movement timing, the roller-movement-timing changing unit moves the pick-up roller from the feeding position to the feed standby position after a rear end of the timing-changing sheet in the sheet conveyance direction passes through the handling member.

5. The sheet conveyance device according to claim 1, wherein the roller-movement-timing changing unit switches in accordance with a size of the recording sheet, which is used as the sheet information, between a roller-movement-timing changing mode where the roller-movement-timing changing unit changes the roller movement timing and a roller-movement-timing fixing mode where the roller-movement-timing changing unit does not change the roller movement timing.

6. The sheet conveyance device according to claim 5, further comprising:

a mode switching unit that switches in response to an input by a user, between the roller-movement-timing changing mode and the roller-movement-timing fixing mode.

7. The sheet conveyance device according to claim 1, wherein the roller-movement-timing changing unit switches a roller-movement-timing mode between a roller-movement-timing changing mode where the roller-movement-timing changing unit changes the roller movement timing and a roller-movement-timing fixing mode where the roller-movement-timing changing unit does not change the roller movement timing according to a kind of the recording sheet, which is used as the sheet information.

8. The sheet conveyance device according to claim 6, further comprising:

a mode switching unit that switches in response to an input by a user, between the roller-movement-timing changing mode and the roller-movement-timing fixing mode.

9. The sheet conveyance device according to claim 1, wherein the locking member enables the recording sheet to be conveyed to the handling member in an unlocked state.

10. The sheet conveyance device according to claim 1, wherein the locking member includes:

the cylindrical portion; and a first portion that abuts against the front end of the recording sheet in the sheet conveyance direction in the locked state, the first portion being formed on an outer circumferential surface of the cylindrical portion.

11. The sheet conveyance device according to claim 10, wherein the locking member further includes:

a second portion that protrudes from the outer circumferential surface of the cylindrical portion, wherein the first portion is formed on the outer circumferential surface of the cylindrical portion opposite to the second portion.

12. The sheet conveyance device according to claim 11, further comprising:

a stopper that includes an engaging portion, wherein the locking member is locked when the second portion is engaged by the engaging portion so as not to be rotated from the given position.

* * * * *